US009388686B2

(12) United States Patent
Konopczynski et al.

(10) Patent No.: US 9,388,686 B2
(45) Date of Patent: Jul. 12, 2016

(54) MAXIMIZING HYDROCARBON PRODUCTION WHILE CONTROLLING PHASE BEHAVIOR OR PRECIPITATION OF RESERVOIR IMPAIRING LIQUIDS OR SOLIDS

(75) Inventors: Michael R. Konopczynski, Spring, TX (US); Eric Davis, El Cerrito, CA (US); John L. Maida, Jr., Houston, TX (US); Etienne M. Samson, Cypress, TX (US); Michel J. Leblanc, Houston, TX (US); Christopher M. Jones, Houston, TX (US); Michael T. Pelletier, Houston, TX (US); Michael L. Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 924 days.

(21) Appl. No.: 13/004,135

(22) Filed: Jan. 11, 2011

(65) Prior Publication Data

US 2012/0018167 A1 Jan. 26, 2012

Related U.S. Application Data

(60) Provisional application No. 61/294,548, filed on Jan. 13, 2010.

(51) Int. Cl.

| | |
|---|---|
| ***E21B 43/12*** | (2006.01) |
| ***E21B 47/10*** | (2012.01) |
| ***E21B 43/14*** | (2006.01) |

(52) U.S. Cl.

CPC ..... *E21B 47/102* (2013.01); *E21B 43/14* (2013.01)

(58) Field of Classification Search

CPC ..... E21B 43/12; E21B 34/08; E21B 49/087; G01F 1/74; G01F 1/44; G01N 33/2823

USPC ..... 166/369

See application file for complete search history.

(56) References Cited

U.S. PATENT DOCUMENTS

| | | | |
|---|---|---|---|
| 2,210,417 | A | 8/1940 | Kinley |
| 2,242,161 | A | 5/1941 | Athy et al. |

(Continued)

FOREIGN PATENT DOCUMENTS

| | | | |
|---|---|---|---|
| CA | 2320394 | A1 | 4/2001 |
| CA | 2626596 | C | 4/2009 |

(Continued)

OTHER PUBLICATIONS

Kading, Horace, and Hutchins, John S., "Temperature Surveys; The Art of Interpretation," American Petroleum Institute Division of Production, Mar. 12-14, 1969, 20 pages, Paper No. 906-14-N, Lubbock, Texas.

(Continued)

*Primary Examiner* — Blake Michener
*Assistant Examiner* — Kipp Wallace
(74) *Attorney, Agent, or Firm* — Lock Lord LLP; Daniel G. Nguyen; Daniel J. Fiorello

(57) ABSTRACT

A method of flowing fluid from a formation, the method comprising: sensing presence of a reservoir impairing substance in the fluid flowed from the formation; and automatically controlling operation of at least one flow control device in response to the sensing of the presence of the substance. A well system, comprising: at least one sensor which senses whether a reservoir impairing substance is present; and at least one flow control device which regulates flow of a fluid from a formation in response to indications provided by the sensor.

18 Claims, 27 Drawing Sheets

(56) References Cited

U.S. PATENT DOCUMENTS 2,739,475 A 3/1956 Nowak
2,803,526 A 8/1957 Nowak
3,480,079 A 11/1969 Guinn et al.
3,540,826 A * 11/1970 Bisberg ..... 356/338
3,794,426 A * 2/1974 Mueller et al. ..... 356/300
3,864,969 A 2/1975 Smith, Jr.
4,046,220 A 9/1977 Glenn, Jr.
4,120,166 A 10/1978 Brooks, Jr.
4,191,250 A 3/1980 Messenger
4,330,037 A 5/1982 Richardson et al.
4,410,041 A 10/1983 Davies et al.
4,520,666 A 6/1985 Coblentz et al.
4,575,260 A 3/1986 Young
4,641,028 A 2/1987 Taylor et al.
4,703,175 A 10/1987 Salour et al.
4,714,342 A 12/1987 Jackson et al.
4,832,121 A 5/1989 Anderson
4,927,232 A 5/1990 Griffiths
4,976,142 A 12/1990 Perales
5,026,141 A 6/1991 Griffiths
5,163,321 A 11/1992 Perales
5,182,779 A 1/1993 D'Agostino et al.
5,194,847 A 3/1993 Taylor et al.
5,249,251 A 9/1993 Egalon et al.
5,271,675 A 12/1993 Fagan et al.
5,326,969 A 7/1994 Fagan et al.
5,364,185 A 11/1994 VanZandt et al.
5,377,160 A 12/1994 Tello et al.
5,380,995 A 1/1995 Udd et al.
5,400,657 A * 3/1995 Kolpak ..... G01F 1/86 73/19.1
5,451,772 A 9/1995 Narendran
5,488,224 A 1/1996 Fagan et al.
5,509,474 A 4/1996 Cooke, Jr.
5,557,406 A 9/1996 Taylor et al.
5,809,826 A * 9/1998 Baker, Jr. ..... 73/75
5,862,273 A 1/1999 Pelletier
5,892,860 A 4/1999 Maron et al.
6,004,639 A 12/1999 Quigley et al.
6,041,860 A 3/2000 Nazzal et al.
6,082,454 A 7/2000 Tubel
6,125,935 A 10/2000 Shahin, Jr.
6,155,098 A 12/2000 Shapiro et al.
6,233,374 B1 5/2001 Ogle et al.
6,233,746 B1 5/2001 Skinner
6,268,911 B1 7/2001 Tubel et al.
6,279,392 B1 8/2001 Shahin, Jr. et al.
6,281,489 B1 8/2001 Tubel et al.
6,305,216 B1 10/2001 Samaroo
6,378,364 B1 4/2002 Pelletier et al.
6,408,943 B1 6/2002 Schultz et al.
6,422,084 B1 7/2002 Fernald et al.
6,437,326 B1 8/2002 Yamate et al.
6,531,694 B2 3/2003 Tubel et al.
6,555,807 B2 4/2003 Clayton et al.
6,557,630 B2 5/2003 Harkins et al.
6,575,621 B1 6/2003 Zlochin
6,588,266 B2 7/2003 Tubel et al.
6,590,647 B2 7/2003 Stephenson
6,618,677 B1 9/2003 Brown
6,751,556 B2 6/2004 Schroeder et al.
6,789,621 B2 9/2004 Wetzel et al.
6,828,547 B2 12/2004 Tubel et al.
6,834,233 B2 12/2004 Economides et al.
6,847,034 B2 1/2005 Shah et al.
6,853,305 B2 * 2/2005 Acosta-Geraldino et al. ..... 340/604
6,912,904 B2 7/2005 Storm, Jr. et al.
6,913,079 B2 7/2005 Tubel
6,913,083 B2 7/2005 Smith
6,919,079 B1 7/2005 Fishman et al.
6,920,395 B2 7/2005 Brown
6,945,095 B2 9/2005 Johansen
6,957,574 B2 10/2005 Ogle
6,977,367 B2 12/2005 Tubel et al.
6,978,832 B2 12/2005 Gardner et al.
6,981,549 B2 1/2006 Morales et al.
6,992,048 B2 1/2006 Reddy et al.
6,997,256 B2 2/2006 Williams et al.
7,000,696 B2 2/2006 Harkins
7,006,918 B2 2/2006 Economides et al.
7,021,146 B2 4/2006 Nash et al.
7,040,390 B2 5/2006 Tubel et al.
7,055,604 B2 6/2006 Jee et al.
7,066,284 B2 6/2006 Wylie et al.
7,086,484 B2 8/2006 Smith, Jr.
7,140,435 B2 11/2006 Defretin et al.
7,140,437 B2 11/2006 McMechan et al.
7,159,468 B2 1/2007 Skinner et al.
7,163,055 B2 1/2007 Coon et al.
7,175,136 B2 2/2007 Shah et al.
7,182,134 B2 2/2007 Wetzel et al.
7,219,729 B2 5/2007 Bostick, III et al.
7,219,730 B2 5/2007 Tilton et al.
7,245,791 B2 7/2007 Rambow et al.
7,255,173 B2 8/2007 Hosie et al.
7,270,002 B2 9/2007 Chen et al.
7,282,697 B2 10/2007 Thomas et al.
7,345,953 B2 3/2008 Crickmore et al.
7,409,858 B2 8/2008 Dria et al.
7,430,903 B2 10/2008 Ramos
7,441,605 B2 10/2008 Coronado et al.
7,458,273 B2 12/2008 Skinner et al.
7,511,823 B2 3/2009 Schultz et al.
7,529,434 B2 5/2009 Taverner et al.
7,997,340 B2 8/2011 Bostick, III et al.
2002/0040963 A1 4/2002 Clayton et al.
2002/0060070 A1 5/2002 Ramos et al.
2002/0125008 A1 * 9/2002 Wetzel et al. ..... 166/278
2002/0179301 A1 12/2002 Schultz et al.
2003/0094281 A1 5/2003 Tubel
2003/0166470 A1 9/2003 Fripp et al.
2003/0205083 A1 11/2003 Tubel et al.
2004/0026076 A1 * 2/2004 Goodwin et al. ..... 166/66.6
2004/0040707 A1 3/2004 Dusterhoft et al.
2004/0084180 A1 5/2004 Shah et al.
2004/0109228 A1 * 6/2004 Aronstam ..... 359/341.3
2004/0113104 A1 6/2004 Maida, Jr.
2005/0120796 A1 6/2005 Nash et al.
2005/0149264 A1 7/2005 Tarvin et al.
2005/0165559 A1 * 7/2005 Nelson ..... 702/27
2005/0283276 A1 * 12/2005 Prescott et al. ..... 700/282
2006/0010973 A1 1/2006 Brown
2006/0109746 A1 5/2006 Crickmore et al.
2006/0133203 A1 6/2006 James et al.
2006/0174693 A1 8/2006 Chen et al.
2007/0234788 A1 10/2007 Glasbergen et al.
2008/0088846 A1 4/2008 Hayward et al.
2008/0236836 A1 10/2008 Weng
2008/0262736 A1 * 10/2008 Thigpen et al. ..... 702/9
2008/0273852 A1 11/2008 Parker et al.
2009/0000785 A1 * 1/2009 Zhan et al. ..... 166/264
2009/0120642 A1 5/2009 Eoff et al.
2009/0155772 A1 * 6/2009 Zebedee et al. ..... 435/5
2009/0236144 A1 * 9/2009 Todd et al. ..... 175/5
2009/0242204 A1 * 10/2009 Buijse et al. ..... 166/302
2010/0018703 A1 * 1/2010 Lovell et al. ..... 166/255.2
2011/0017468 A1 * 1/2011 Birch et al. ..... 166/369
2011/0042070 A1 * 2/2011 Hsu et al. ..... 166/250.01
2011/0127032 A1 * 6/2011 Rossi et al. ..... 166/250.01
2011/0308788 A1 12/2011 Ravi et al.
2012/0013893 A1 1/2012 Maida et al.
2012/0132417 A1 5/2012 Dria et al.

FOREIGN PATENT DOCUMENTS

EP 768527 A2 10/1996
EP 1464204 B1 12/2002
EP 1466138 B1 1/2003
EP 1468258 B1 1/2003
EP 0910725 B1 7/2003
EP 1355166 A2 10/2003
EP 1355169 A2 10/2003
EP 1357401 A2 10/2003

(56) References Cited

FOREIGN PATENT DOCUMENTS

| | | | |
|---|---|---|---|
| EP | 1563323 | B1 | 11/2003 |
| GB | 2230086 | A | 10/1990 |
| GB | 2354782 | A | 4/2001 |
| GB | 2362462 | A | 11/2001 |
| GB | 2364380 | A | 1/2002 |
| GB | 2364381 | A | 1/2002 |
| GB | 2364384 | A | 1/2002 |
| GB | 2367890 | A | 4/2002 |
| GB | 2384108 | A | 7/2003 |
| GB | 2384313 | A | 7/2003 |
| GB | 2384644 | A | 7/2003 |
| GB | 2386625 | A | 9/2003 |
| GB | 2386687 | A | 9/2003 |
| GB | 2397648 | A | 7/2004 |
| GB | 2408327 | A | 5/2005 |
| GB | 2408328 | A | 5/2005 |
| GB | 2408329 | A | 5/2005 |
| GB | 2408531 | A | 6/2005 |
| SU | 1294985 | A1 | 3/1987 |
| WO | 03021301 | A2 | 3/2003 |
| WO | 03059009 | A1 | 7/2003 |
| WO | 03062750 | A1 | 7/2003 |
| WO | 03062772 | A2 | 7/2003 |
| WO | 03062772 | A3 | 7/2003 |
| WO | 03081186 | A2 | 10/2003 |
| WO | 03081186 | A3 | 10/2003 |
| WO | 03106940 | A1 | 12/2003 |
| WO | 04001356 | A2 | 12/2003 |
| WO | 2004020789 | A2 | 3/2004 |
| WO | 2004020790 | A2 | 3/2004 |
| WO | 2004042425 | A1 | 5/2004 |
| WO | 2004042425 | A8 | 5/2004 |
| WO | 2004076815 | A1 | 9/2004 |
| WO | 2004085795 | A1 | 10/2004 |
| WO | 2004114487 | A1 | 12/2004 |
| WO | 2005035943 | A1 | 4/2005 |
| WO | 2005064117 | A1 | 7/2005 |
| WO | 2005116388 | A1 | 12/2005 |
| WO | 2008006880 | A1 | 1/2008 |
| WO | 2008098380 | A1 | 8/2008 |
| WO | 2008119951 | A2 | 10/2008 |
| WO | 2008119951 | A3 | 10/2008 |
| WO | 2010020781 | A1 | 2/2010 |
| WO | 2010020795 | A1 | 2/2010 |
| WO | 2010020796 | A1 | 2/2010 |
| WO | 2011049571 | A1 | 4/2011 |

OTHER PUBLICATIONS

Sakaguchi, Keiichi, and Matsushima, Nobuo, "Temperature Profile Monitoring in Geothermal Wells by Distributed Temperature Sensing Technique," Geothermal Resources Council Transactions, Oct. 1995, 4 pages, vol. 19, Geological Survey of Japan, Higashi, Tsukuba, Ibaraki, Japan.

Henninges, J., Zimmermann, G., Buttner, G., Schrotter, J., Erbas, K, and Huenges, E.,"Fibre-Optic Temperature Measurements in Boreholes," FKPE-Workshop, Oct. 23-24, 2003, 9 pages, Hannover, Germany.

Johnson, David O., and Van Domelen, Mary, "StimWatch Stimulation Monitoring Service," Halliburton 2006 Special Meritorious Award for Engineering Innovation, 2006, 4 pages, Houston, Texas.

Knott, Terry, "Wytch Farm Sees the Light," Offshore Engineer, Dec. 1, 2000, 7 pages, oilonline.com.

Kading, Horace, "Shut-in Temperature Profiles Tell Where the Water Went," The Oil and Gas Journal, May 13, 1968, pp. 77-79.

Schlumberger, Oilfield Glossary, Term "Joule-Thomson," 2006, 1 page.

Halliburton Reservoir Performance Monitoring, 2005, 2 pages.

Nowak, T.J., "The Estimation of Water Injection Profiles from Temperature Surveys," Petroleum Transactions, AIME, 1953, pp. 203-212, vol. 198.

Sakaguchi, Keiichi, and Matsushima, Nobuo, "Temperature Logging by the Distributed Temperature Sensing Technique During Injection Tests," Proceedings World Geothermal Congress, May 28-Jun. 10, 2000, pp. 1657-1661, Kyushu—Tohoku, Japan.

Grobwig, St., Graupner, A. Hurtig, E., Kuhn, K., and Trostel, A., "Distributed Fibre Optical Temperature Sensing Technique—A Variable Tool for Monitoring Tasks," 8th International Symposium on Temperature and Thermal Measurements in Industry and Science, Jun. 19-21, 2001, pp. 9-17.

Hurtig, E., Ache, B., Grobwig, S., and Hanel, K., "Fibre Optic Temperature Measurements: A New Approach to Determine the Dynamic Behaviour of the Heat Exchanging Medium Inside a Borehole Heat Exchanger," Terrastock 2000, 8th International Conference on Thermal Energy Storage, Aug. 28-Sep. 1, 2000, Stuttgart, Germany.

Ikeda, N., Uogata,K., Kawazoe, S., and Haruguchi, K., "Delineation of Fractured Reservoir by Transient Temperature Analysis Using Fiber Optic Sensor," Proceedings World Geothermal Congress, May 28-Jun. 10, 2000, pp. 2617-2621, Kyushu—Tohoku, Japan.

Halliburton, "The Impact of Wellbore Phenomena on Fluid Placement and Zonal Coverage", Gerard Glasbergen, Nov. 1-3, 2005, 9 pages.

Oxy Elk Hills, "Using Fiber Optics to Divert Acid on the Fly in the Monterey Shale", Ray Clanton, May 8-10, 2006, 46 pages.

Pruett Industries, "Fiber Optic Distributed Temperature Sensor 'DTS' ", dated at least as early as 2001, 51 pages.

Carnahan, B.D.; Clanton, R.W.; Koehler, K.D.; Harkins; G.O.; and Williams, G.R.; Fiber Optic Temperature Monitoring Technology, SPE 54599; May 26-28, 1999; Anchorage, AK, US.

Saputelli, L.; Mendoza, H.; Finol, J.; Rojas, L.; Lopez, E.; Bravo, H.; and Buitriago, S.; Monitoring Steamflood Performance through Fiber Optic Temperature Sensing, SPE 54104; Mar. 17-19, 1999; Bakersfield, CA, US.

Karaman, O.; Kutlik, R.; and Kluth, E.; A Field Trial to Test Fiber Optic Sensors for Downhole Temperature and Measurements, West Coalinga Field, California, SPE 35685; May 22-24, 1996; Anchorage, AK, US.

Botto, G.; Maggioni, B.; and Schenato, A.; Electronic, Fiber-Optic Technology: Future Options for Permanent Reservoir Monitoring, SPE 28484; Sep. 25-28, 1994; New Orleans, LA, US.

Sjornstad, B.; Kvisteroy, T.; and Eriksrud, M.; Fibre Optic Well Monitoring System, SPE 23147; Sep. 3-6, 1991: pp. 425-432; Aberdeen, UK.

International Search Report with Written Opinion issued Aug. 19, 2010, for US Patent Application Serial No. PCT/US10/024100, 14 pages.

Baker Hughes Press Release; Shell and Baker Hughes Pioneer Real-time Compaction Imaging System; Jun. 26, 2009; 2 pages; Houston, Texas.

Choi, K.N., Juarez, J.C., Taylor, H.F.; Distributed Fiber-Optic Pressure/Seismic Sensor for Low-Cost Monitoring of Long Perimeters; SPIE vol. 5090, E.M. Carapezza, ed. pp. 134-141; Apr. 2003; 10 pages; Orlando, Florida.

Photonics.com; Fiber Optic Intrusion Sensor Protects Perimeters; Photonics.com Feature Articles; Jan. 28, 2005; 2 pages; Laurin Publishing; Pittsfield, Massachusetts.

Thevenaz, Luc; Review & Progress in Distributed Fiber Sensing; Ecole Polytechnique Federale de Lausanne, Laboratory of Nanophotonics & Metrology; undated; 28 pages; Lausanne, Switzerland.

Nikles, Marc; Fibre Optic Distributed Scattering Sensing System: Perspectives and Challenges for High Performance Applications; [Reprinted from the proceedings of] SPIE publication vol. 6619, Third European Workshop on Optical Fibre Sensors; Jul. 4-6, 2007; 8 pages; Napoli, Italy.

Lobo Ribeiro, A. B., Eira, N., Sousa, J. M., Guerreiro, P. T. and Salcedo, A.R.; Multi-Point Fibre Optic Hot-Spot Network Integrated Into a High Power Transformer; SPIE vol. 6619, 66193V; 2007; 4 pages; Third European Workshop on Optical Fibre Sensors; Portugal.

Halliburton, Pinnacle Reservoir Monitoring; StimWatch® Stimulation Monitoring Service; H04481; Jun. 2010; 4 pages.

Office Action issued Nov. 29, 2007, for U.S. Appl. No. 11/398,483, 20 pages.

Office Communication issued Dec. 10, 2007, for U.S. Appl. No. 11/398,483, 3 pages.

(56) References Cited

OTHER PUBLICATIONS

Office Action issued Sep. 2, 2008, for U.S. Appl. No. 11/396,503, 23 pages.
Office Action issued Apr. 14, 2009, for U.S. Appl. No. 11/398,503, 9 pages.
Office Action issued Jan. 12, 2010, for U.S. Appl. No. 12/167,884, 16 pages.
Office Action issued Jan. 13, 2010, for U.S. Appl. No. 12/167,910, 16 pages.
Office Action issued Jun. 26, 2012 for U.S. Appl. No. 12/816,749, 46 pages.
International Search Report with Written Opinion issued Nov. 8, 2012 for PCT Patent Application No. PCT/GB11/000907, 11 pages.
Office Action issued Dec. 10, 2009, for U.S. Appl. No. 11/398,503, 8 pages.
Naotsugu Ikeda, "Fractured Reservoir Management by Fiber Optic Distributed Temperature Measurement," Sep. 27-28, 2000, 6 pages.
John Fagley, H.S. Fogler, C.B. Davenport, and R.S. Millhone, "An Improved Simulation for Interpreting Temperature Logs in Water Injection Wells," SPE 10081, Oct. 1982, 10 pages.
R.N. Horne, J.L. Perrick, and J. Barua, "The Use of Microcomputers in Well Test Data Acquisition and Analysis," SPE 15308, Jun. 18-20, 1986, SilverCreek, CO, 9 pages.
M.Y. Soliman, "Technique for Considering Fluid Compressibility and Temperature Changes in Mini-Frac Analysis," SPE 15370, Oct. 5-8, 1986, New Orleans, LA, 11 pages.
W.S. Lee, "Study of the Effects of Fluid Rheology on Minifrac Analysis," SPE 16916, Sep. 27-30, 1987, Dallas, TX, 10 pages.
B. Bjornstad, T. Kvisteroy, and M. Eriksrud, "Fibre Optic Well Monitoring System," SPE 23147, Sep. 3-6, 1991, Aberdeen, 8 pages.
M.P. Cleary, D.E. Johnson, H.H. Kogsboll, K.A. Owens, K.F. Perry, C.J. de Pater, A. Stachel, H. Schmidt, and M. Tambini, "Field Implementation of Proppant Slugs to Avoid Premature Screen-Out of Hydraulic Fractures with Adequate Proppant Concentration," SPE 25892, Apr. 12-14, 1993, Denver, CO, 16 pages.
G. Botto, B. Maggioni and A. Schenato, "Electronic, Fiber-Optic Technology: Future Options for Permanenet Reservoir Monitoring," SPE 28484, Sep. 25-28, 1994, New Orleans, LA, 10 pages.
O.S. Karaman, R.L. Kutlik, and E.L. Kluth, "A Field Trial to Test Fiber Optic Sensors for Downhole Temperature and Pressure Measurements, West Coalinga Field, California," SPE 35685, May 22-24, 1996, Anchorage, AK, 7 pages.
L. Saputelli, H. Mendoza, J. Finol, L. Rojas, E. Lopez, H. Bravo, and S. Buitriago, "Monitoring Steamflood Performance through Fiber Optic Temperature Sensing," SPE 54104, Mar. 17-19, 1999, Bakersfield, CA, 7 pages.
B.D. Carnahan, R.W. Clanton, K.D. Koehler, G.O. Harkins, and G.R. Williams, "Fiber Optic Temperature Monitoring Technology," SPE 54599, May 26-28, 1999, Anchorage, AK, 10 pages.
Klas Eriksson, "Fiber Optic Sensing—Case of 'Solutions Looking for Problems'," SPE 71829, Aberdeen, Scotland, Sep. 4-7, 2001, 5 pages.
D. Callison, J. Jones, B. Shelley, and R. Lockman, "Integrated Modeling of a Field of Wells—An Evaluation of Western Shallow Oil Zone Completion Practices in the Elk Hills Field, Kern County, California," SPE 76724, Anchorage, AK, May 20-22, 2002, 10 pages.
G. Corbett, E. Fagervik, S. Christie, B. Smith, and K. Falcon, "Fiber Optic Monitoring in Openhole Gravel Pack Completions," SPE 77682, San Antonio, TX, Sep. 29-Oct. 2, 2002, 14 pages.
G.A. Brown, and A. Hartog, "Optical Fiber Sensors in Upstream Oil & Gas," SPE 79080, 2002, 3 pages.
G. Brown, D. Storer, K. McAllister, M. al-Asimi, and K. Raghavan, "Monitoring Horizontal Producers and Injectors During Cleanup and Production Using Fiber-Optic-Distributed Temperature Measurements," SPE 84379, Oct. 5-8, 2003, Denver, CO, 6 pages.
D.O. Johnson, R. Sugianto, P.H. Mock, and C.H. Jones, "Identification of Steam-Breakthrough Intervals with DTS Technology," SPE 87631, Feb. 2004, 8 pages.
H. Foucault, D. Poilleux, A. Djurisic, M. Slikas, J. Strand, and R. Silva, "A Successful Experience for Fiber Optic and Water Shut Off on Horizontal Wells With Slotted Liner Completion in an Extra Heavy Oil Field," SPE 89405, Apr. 17-21, 2004, Tulsa, OK, 6 pages.
B. Hasebe, A. Hall, B. Smith, J. Brady, and P. Mehdizadeh, "Field Qualification of Four Multiphase Flowmeters on North Slope, Alaska," SPE 90037, Sep. 26-29, 2004, Houston, TX, 13 pages.
A. Bond, C. Blount, T. Kragas, and S. Mathias, "Use of a Fiber Optic Pressure/Temperature Gauge in an Exploration Well to Minimize Formation Damage Potential and Reduce Costs During Production Testing," SPE 90130, Sep. 26-29, 2004, Houston, TX, 10 pages.
L.B. Ouyang, and D. Belanger, "Flow Profiling via Distributed Temperature Sensor (DTS) System—Expectation and Reality," SPE 90541, Sep. 26-29, 2004, Houston, TX, 14 pages.
D.K. Nath, "Fiber Optics Used to Support Reservoir Remperature Surveillance in Duri Steamflood," SPE 93240, Apr. 5-7, 2005, Jakarta, Indonesia, 9 pages.
G. Glasbergen, D. van Batenburg, M. van Domelen, and R. Gdanski, "Field Validation of Acidizing Wormhole Models," SPE 94695, May 25-27, 2005, Scheveningen, The Netherlands, 11 pages.
G. Brown, V. Carvalho, A. Wray, A. Sanchez, and G. Gutierrez, "Slickline With Fiber-Optic Distributed Temperature Monitoring for Water-Injection and Gas Lift Systems Optimization in Mexico," SPE 94989, Jun. 20-23, 2005, Rio de Janeiro, Brazil, 10 pages.
K. Yoshioka, D. Zhu, A.D. Hill, P. Dawkrajai, and L.W. Lake, "A Comprehensive Model of Temperature Behavior in a Horizontal Well," SPE 95656, Oct. 9-12, 2005, Dallas, TX, 15 pages.
G. Gao, and Y. Jalali, "Interpretation of Distributed Temperature Data During Injection Period in Horizontal Wells," SPE 96260, Oct. 9-12, 2005, Dallas, TX, 8 pages.
V. Pimenov, G. Brown, V. Tertychnyi, A. Shandrygin, and Y. Popov, "Injectivity Profiling in Horizontal Wells Through Distributed Temperature Monitoring," SPE 97023, Oct. 9-12, 2005, Dallas, TX, 8 pages.
D.K. Nath, R. Sugianto, and D. Finley, "Fiber-Optic Distributed Temperature Sensing Technology Used for Reservoir Monitoring in an Indonesia Steam Flood," SPE 97912, Nov. 1-3, 2005, Calgary, Alberta, Canada, 10 pages.
R.W. Clanton, J.A. Haney, R. Pruett, C.L. Wahl, J.J. Goiffon, and D. Gualtieri, "Real-Time Monitoring of Acid Stimulation Using a Fiber-Optic Dts System," SPE 100617, May 8-10, 2006, Anchorage, AK, 10 pages.
Office Action issued Feb. 28, 2013 for U.S. Appl. No. 12/816,749, 12 pages.
International Search Report and Written Opinion issued Aug. 19, 2010, for International Patent Application No. PCT/10/024100, 14 pages.
Society of Petroleum Engineers, "Producation Performance of a Retrograde Gas Reservoir: A Case Study of the Arun Field", SPE 28749, dated Nov. 7-10, 1994, 8 pages.
Shell Exploration & Production, "EP Technology—Tight Gas Potential", No. 2, dated 2009, 32 pages.
Luc Thevenaz, "Review and Progress in Distributed Fiber Sensing", OSA/OFS, Optical Society of America, dated 2006, 6 pages.
Specification and Drawings for PCT Patent Application No. PCT/US13/55365 filed Aug. 16, 2013, 45 pages.

* cited by examiner

MAXIMIZING HYDROCARBON PRODUCTION WHILE CONTROLLING PHASE BEHAVIOR OR PRECIPITATION OF RESERVOIR IMPAIRING LIQUIDS OR SOLIDS

BACKGROUND

This disclosure relates generally to equipment utilized and operations performed in conjunction with a subterranean well and, in an example described below, more particularly provides for maximizing hydrocarbon production while controlling phase behavior or precipitation of reservoir impairing liquids or solids.

Many hydrocarbon reservoirs contain substances which are in solution with the hydrocarbon fluids, be they gas or liquid, or are in an innocuous state such that they can flow freely through the reservoir geologic formation with the hydrocarbon fluids. Most exploitation schemes of hydrocarbon reservoirs involve drilling a well into the reservoir rock, and reducing the pressure in the well to induce flow of the reservoir fluids into the wellbore, so that they can be lifted to the surface. This reduction in pressure in the wellbore permeates into the reservoir itself, creating a pressure gradient deep into the reservoir.

With some fluids, particularly gases, the reduction in pressure is accompanied by a reduction in temperature of the fluids due to isentropic expansion. Unfortunately, this change in pressure and temperature in the reservoir and wellbore can induce physical phase or chemical changes in the aforementioned substances such that these substances precipitate, condense or sublimate in the reservoir pore spaces, natural fractures, induced fractures in the near wellbore region of the reservoir, and in the wellbore itself.

Such precipitation, condensation or sublimation can impair the ability of the hydrocarbon reservoir fluids to flow through the reservoir and into the wellbore, and can cause plugging of the rock and the conduits in the wellbore. Examples of these substances are water condensate, hydrocarbon condensate (in gas-condensate wells), waxes, paraffins, asphaltenes, elemental sulfur, salts and scales. The impact of this problem is greatly accentuated if the reservoir rock formation is particularly "tight", or characterized by low permeability.

Therefore, it would be advantageous to control the downhole flowing conditions of pressure and temperature using intelligent well technology, that is, sensing and/or flow control, to prevent or minimize the precipitation, condensation or sublimation of these substances, thus ensuring optimum hydrocarbon production rates from the well and maximizing ultimate hydrocarbon recovery from the reservoir. This control may involve human decision making, or may be autonomous.

SUMMARY

In the disclosure below, improvements are brought to the arts of preventing impairment of reservoirs and preventing production of condensates, precipitates and other undesired substances. One example is described below in which a downhole sensor can detect presence of a reservoir impairing substance in a flowing fluid. Another example is described below in which a flow control device can variably restrict flow of the fluid from a formation, in response to the sensor detecting the presence of the reservoir impairing substance.

In one aspect a method of producing fluid from a formation is provided to the art by this disclosure. The method can include sensing presence of a reservoir impairing substance in the fluid produced from the formation, and automatically controlling operation of a flow control device in response to the sensing of the presence of the substance.

In another aspect, this disclosure provides to the art a well system. The well system can include at least one sensor which senses whether a reservoir impairing substance is present, and at least one flow control device which regulates flow of a fluid from a formation in response to indications provided by the sensor.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

An example where impairment of reservoir productivity is well known in the oil and gas industry is in the production of "tight" gas-condensate reservoirs. The hydrocarbon fluids in these reservoirs are a mixture of multiple weights of hydrocarbon molecules.

Figure 1:
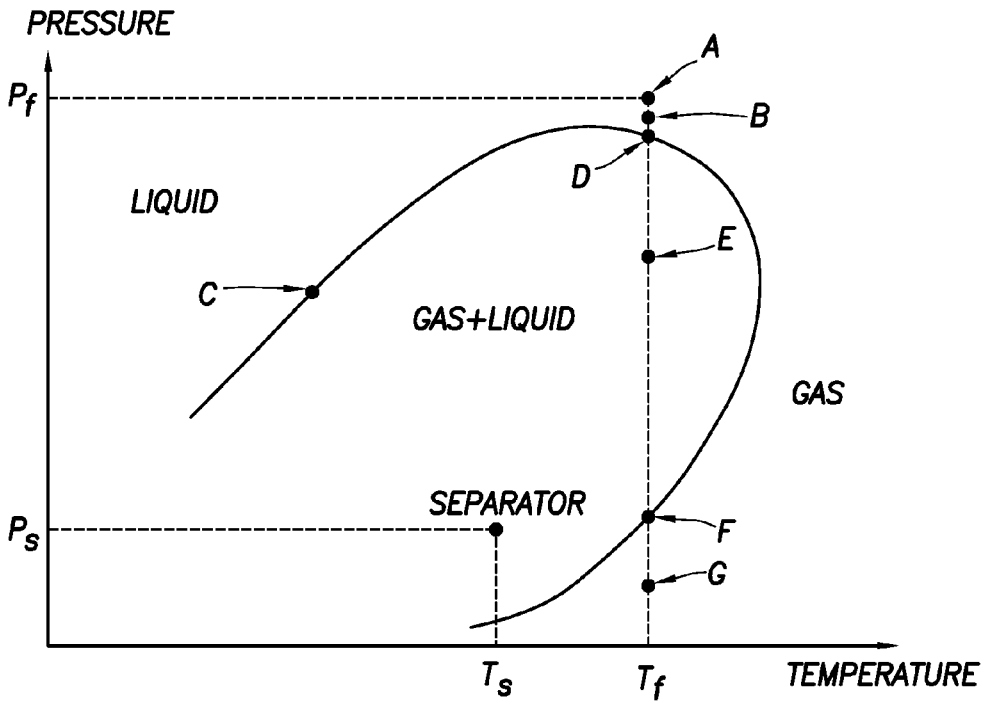
FIG. 1 is a typical phase diagram for a hydrocarbon gas-condensate fluid.

In the initial state of these gas-condensate reservoirs, the hydrocarbon liquids are in solution in the hydrocarbon gas phase, and move easily through the reservoir rock pores. This process is represented by FIG. 1, a typical phase diagram for a hydrocarbon gas-condensate fluid.

The initial state in this example is represented by point A. $P_f$ designates initial formation pressure, and $T_f$ designates formation temperature. $P_s$ designates pressure in a production facility separator, and $T_s$ designates separator temperature.

The pressure of the gas in the rock is reduced (point B in FIG. 1) by extraction of the hydrocarbon gas as part of the exploitation process, until it reaches a critical point (point D) in its physical phase behavior, often called the "dew-point" where hydrocarbon liquids begin to condense out of the gas phase. Because this condensation process occurs with a reduction in pressure, contrary to the phase behavior of most pure substances, the liquids formed are sometimes called "retrograde" condensate.

Further pressure reduction causes more liquids to condense in the form of fine droplets, which coalesce into droplets (point E). The droplets adhere to the rock matrix and gather at the pore throats, restricting or blocking the flow of the gas phase through the pore throats, and thus impairing the productivity of the well.

This phenomenon is known as near-wellbore condensate drop-out impairment. Continued reduction in pressure of the fluids results in a reversal of the process, where the liquids vaporize back into a gas state (point F).

Conventional strategies to deal with this phenomenon include:

1) Managing the pressure reduction (drawdown) of the reservoir in the near wellbore region to maintain the reservoir pressure above the dew point as long as possible in the depletion process, until the reservoir must be dropped below the dew point.
2) Extracting the heavier hydrocarbons from the produced gas-condensate mix, then re-injecting the "dry" gas back into the reservoir to keep the reservoir pressure above the dew-point (dry gas recycling).
3) Increasing the amount of reservoir rock that is contacted by the wellbore so that the pressure drawdown is reduced for an economic production rate of gas-condensate. This is done by drilling high angle wells, long horizontal wells, or horizontal multi-lateral wells, or by creating large fractures by hydraulic pumping of liquids downhole at pressures above the mechanical strength of the reservoir rock. The fractures are kept open with proppant or by chemically (acid) etching the fracture faces. In horizontal wells, multiple fractures may be created from one wellbore.

Unconventional strategies proposed include:

1) Heating the near wellbore rock by electric, combustion or chemical means to re-vaporize the condensate. This concept may be impractical for economic production rates of gas.
2) Treating the reservoir rock with chemicals to modify the phase behavior of the condensate, or modify the interfacial tension between the condensate and the rock, thus making it easier to produce the condensate in the near wellbore region.

Condensate is one example of a reservoir imparing substance. Other examples can include precipitates and sublimates of reservoir substances.

The design, functionality and application of intelligent well technology, downhole sensing and flow control, for the purpose of managing hydrocarbon well production and reservoir depletion is well understood and documented in the industry. However, the potential and methodology for using the technology has not been recognized and applied for the control and management of the precipitation, condensation or sublimation of materials through phase or chemical reactions which have the potential to impair inflow into a well, as described above. This methodology is particularly applicable in combination with other remedial methods described above, particularly those which seek to improve the amount of reservoir rock contacted, such as horizontal wells, multi-lateral wells or wells using multiple induced hydraulic fractures.

Figure 2:
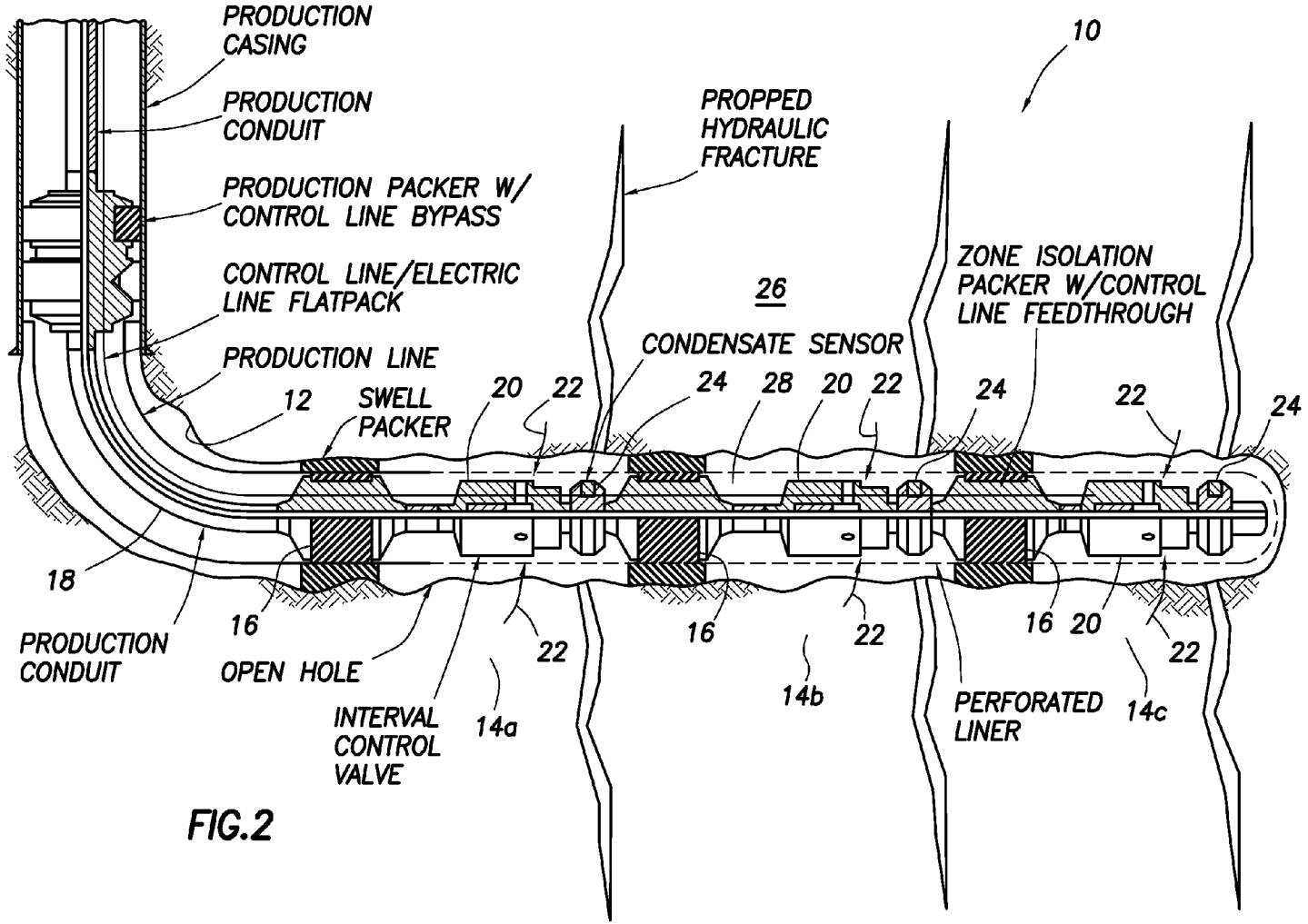
FIG. 2 is a representative partially cross-sectional view of a well system and associated method which can embody the principles of this disclosure.

An example of a well system 10 in which this methodology may be practiced is representatively illustrated in FIG. 2. Of course methods described herein may be practiced with other types of well systems in keeping with the principles of this disclosure.

In the present system 10, a wellbore 12 is segmented into one or more zones 14*a-c* using packers 16, with a production conduit 18 connecting all zones. Inflow Control Valves (ICV's, sometimes referred to as downhole chokes) or other types of flow control devices 20 are placed on the production conduit 18 in each zone 14*a-c* with the capability of restricting the flow of fluids 22 from the annulus 28 between the production conduit and the wellbore 12, into the production conduit, or shutting off the flow completely.

Thus, the flowrate and/or pressure in each of the zones 14*a-c* can be controlled independently, and hence, the pressure drawdown on the reservoir rock adjacent to each zone can be controlled independently. Each zone 14*a-c* in the wellbore 12 may be associated with a variety of other well construction or reservoir features, such as individual hydraulic fractures in a multi-fracture well, individual lateral branching points in a multi-lateral well, individual reservoir compartments or layers in a compartmentalized or multi-layer reservoir, individual reservoirs in a well which intersects multiple independent reservoirs, or the zones may be located at any arbitrary spacing.

Within each zone 14*a-c* in the segmented wellbore 12, sensors 24 are located to monitor physical conditions within the annulus 28 in the zone. These sensors 24 could be pressure and temperature sensors, but specifically for this system 10, may include sensors specifically designed to detect the formation of the unwanted solids or liquids as a result of chemical or phase change, such as the detection of condensed water or hydrocarbon liquid, the detection of wax or paraffin, or the detection of elemental sulfur, salts or scales. The sensors 24 may be electronic, optical or acoustic in nature, active or passive, and may or may not transmit information to the surface through the wellbore 12 or other means.

These sensors 24 preferably are relatively sensitive to small quantities of the unwanted solids or liquids, and preferably do not impede or alter the flow in the well or from the wellbore 12. The sensors 24 may detect the presence of the unwanted materials either in the annulus 28 of the wellbore 12, or in the earth formation 26 proximate the wellbore. For instance, by measuring the acoustic or electric properties of the formation 26 proximate the wellbore 12, the formation of liquids in the pore spaces in the formation may be detected.

Where the sensor 24 is detecting the formation or presence of the unwanted solids in a flow stream, the sensor is preferably placed in the flow stream or adjacent to the flow stream to that it can rapidly react to changes in the flow stream.

FIG. 2 illustrates one example of a multi-zone intelligent completion in a multi-fracture treated horizontal well suitable for tight gas-condensate reservoir exploitation, using condensate sensors 24 and ICV's to control condensate formation. However, other types of completions can benefit from the principles described herein, as well.

The concepts described herein can include a method and process by which intelligent completion designs are used to control the formation of the unwanted materials. The pressure within the annulus 28 of each zone 14*a-c* is reduced by opening the flow control device 20 within each zone so that communication is established with the production conduit 18, the pressure in which is controlled by a surface production choke or artificial lift means (not shown in FIG. 2). The flow control device 20 creates a pressure drop between the annulus 28 in each zone 14*a-c* and the production conduit 18 under a flowing condition, the amount of the pressure drop being controlled by adjustment of the flow control device.

Flow of fluids 22 from the reservoir rock proximate each zone 14*a-c* is induced by the pressure gradient created by reducing the pressure in the annulus 28 in each zone. If the pressure drawdown is too great, the unwanted materials will begin to precipitate, condense or sublimate in the wellbore 12, and if the pressure is below the critical point in the near wellbore region of the reservoir rock, the materials will form there, creating impairment and plugging of the near wellbore region.

Fluid production without impairment of the reservoir is maximized by drawing down the pressure in the wellbore annulus 28 to a point just above the pressure at which the undesirable material begins to form. With knowledge of the composition and phase/chemical behavior of the reservoir fluids 22, the critical pressure and temperature (for instance, the dewpoint of gas-condensate systems) can be determined. This information is most often obtained through laboratory analysis of either downhole reservoir fluid samples obtained at near virgin condition, or from recombinant samples from produced fluids.

With pressure and temperature sensors 24 in the annulus 28 of each zone 14*a-c*, the inflow conditions (drawdown) for each zone can be monitored and controlled with the flow control device 20 such that the undesirable materials do not form.

Figure 3:
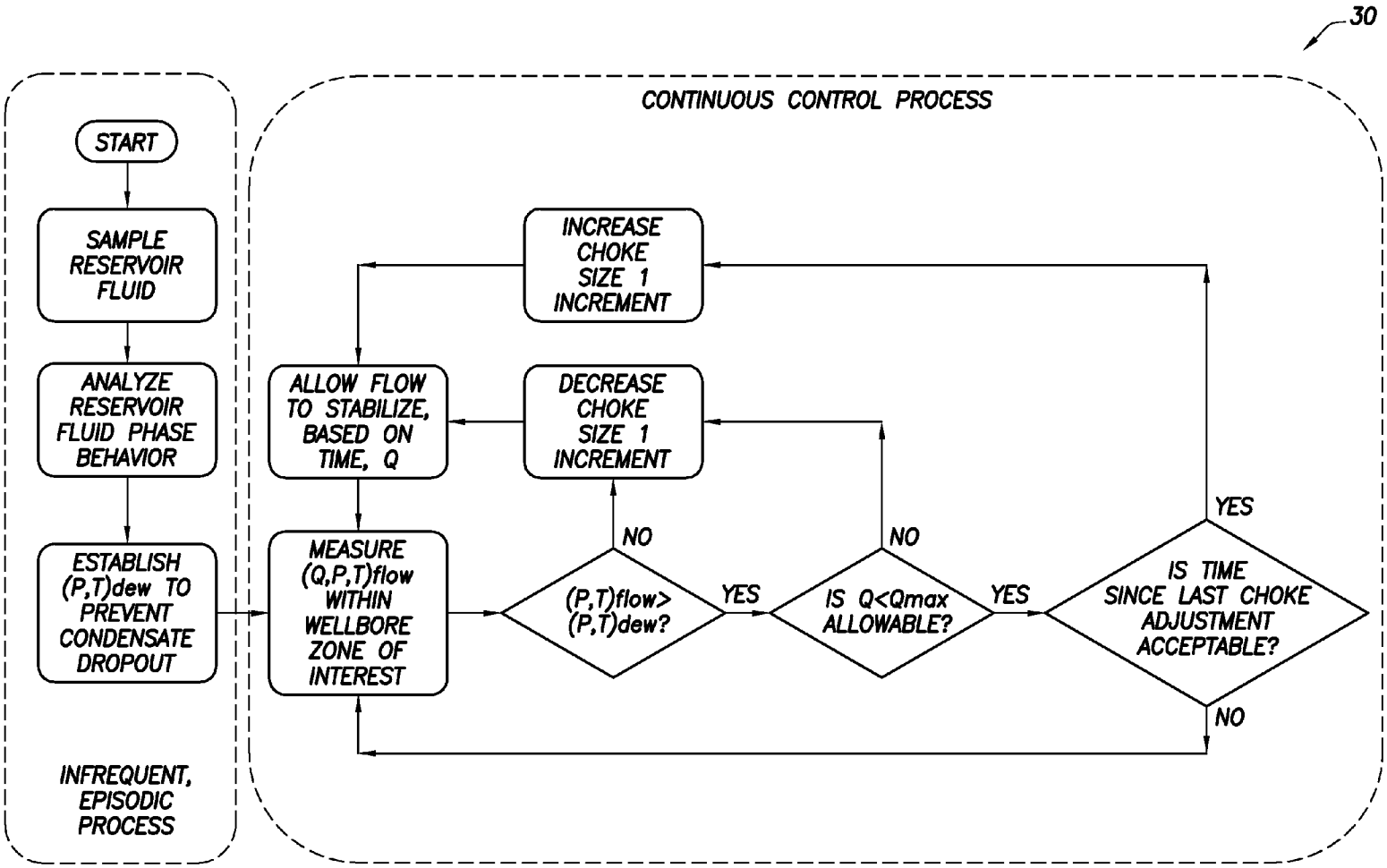
FIG. 3 is a representative flow chart for a method of mitigating formation of condensate.

This method 30 is representatively illustrated in flowchart form in FIG. 3 for a zonal condensate control process based on PVT (pressure, volume (or volumetric flow rate) and temperature parameters). Total well production can be maximized without impairment by independently monitoring and controlling each zone 14*a-c* in the well system 10 using the method 30.

Unfortunately, establishing the phase/chemical behavior of the reservoir fluids 22 by periodic and infrequent sampling can result in less than optimal control results because reservoir fluid composition can be different in different areas of the reservoir, in different layers or components of the reservoir, and can change with time as the reservoir is depleted or as fluids are injected into the reservoir or migrate through the reservoir. This spatial and temporal variability in reservoir fluids 22 is not well represented by sampling strategies, and thus the control method 30 described above based on pressure and temperature measurements in each zone 14*a-c* is less than ideal.

For this reason, a preferred embodiment of the present system 10 includes downhole sensors 24 located in each zone 14*a-c* which can directly or indirectly detect the precipitation, condensation or sublimation of the unwanted materials. For instance, when the presence of liquid condensate is detected (e.g., in mist, droplet or pool form) in the annulus 28 in a zone 14*a-c*, the flow control device 20 associated with that zone can by adjusted to create more back pressure and increase the pressure in that zone.

Figure 4:
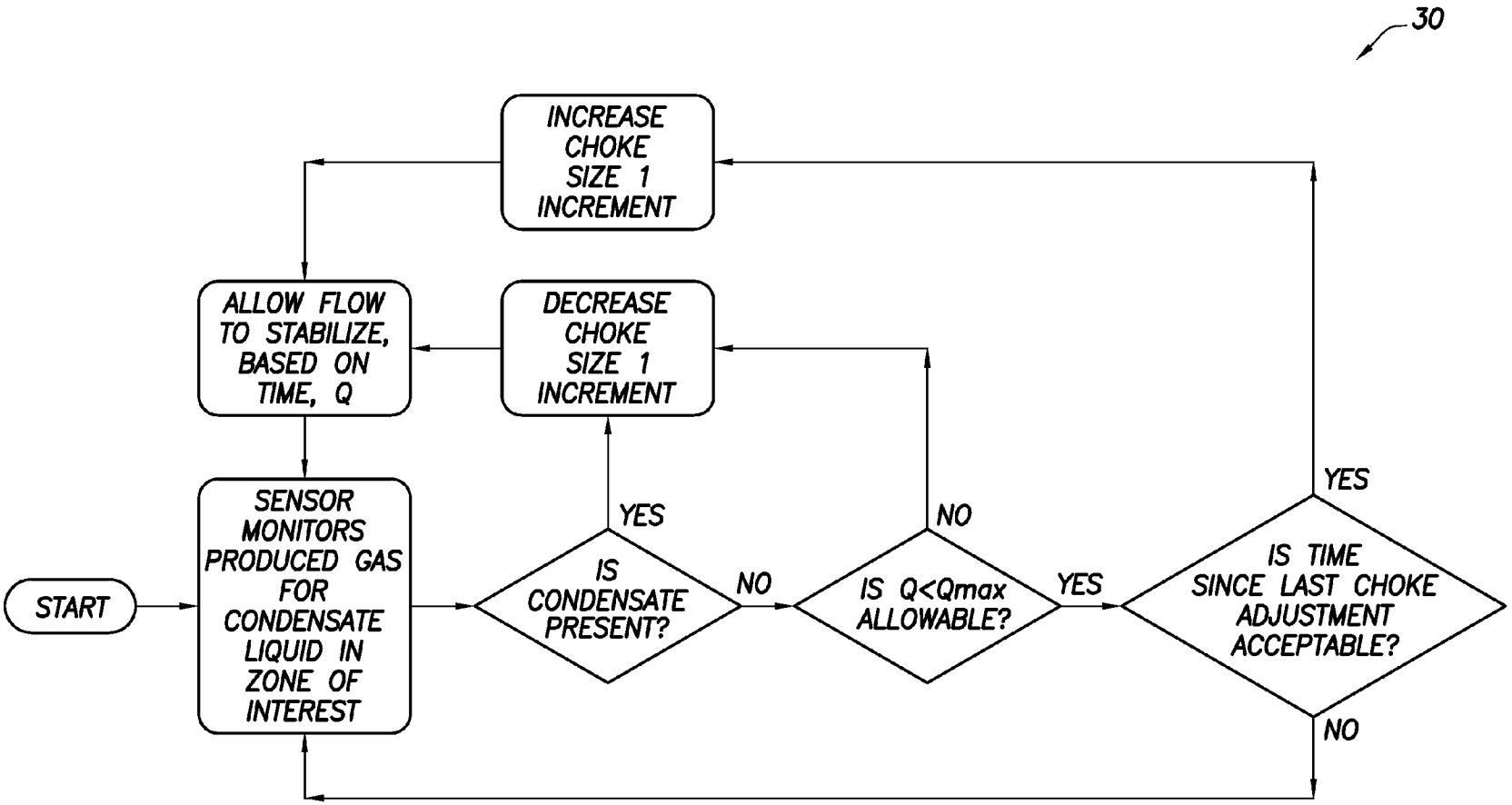
FIG. 4 is a representative flow chart for an improvement to the method.

FIG. 4 illustrates a closed loop control process which can be created with the sensors 24 and the flow control devices 20 to automate this method 30. One advantage of the FIG. 4 method 30 over the FIG. 3 method is that the FIG. 4 method utilizes the sensors 24 which directly or indirectly detect the presence of the unwanted materials.

Such a closed loop methodology may use a PID (proportional/integral/derivative) control methodology or time domain modulation in order to avoid over-adjusting the valve, and to allow time for the unwanted materials to go back into solution in the reservoir fluid 22.

Note that, in the FIG. 3 version, a comparison is made for each zone 14*a-c* between ($P_{flow}$, $T_{flow}$) and ($P_{dew}$, $T_{dew}$) to determine whether the fluid 22 is above the critical point (point D in FIG. 1). If not, then liquid hydrocarbons can condense, and so the flow control device 20 for that zone 14*a-c* is adjusted to increasingly restrict flow of the fluid 22 into the production conduit 18 (thereby increasing pressure in the corresponding zone 14*a-c*). If ($P_{flow}$, $T_{flow}$) is greater than ($P_{dew}$, $T_{dew}$), and flow of the fluid is not greater than a specified maximum flow rate (i.e., $Q<Q_{max}$ allowable), then flow through the flow control device 20 can be increased by decreasing restriction to flow through the flow control device.

In the FIG. 4 version, a determination is made whether condensate is present in the annulus 28 of each zone 14*a-c*. If condensate or another unwanted material is present (as sensed by the corresponding sensor 24), then the flow control device 20 for that zone 14*a-c* is adjusted to increasingly restrict flow of the fluid 22 into the production conduit 18. If condensate or another unwanted material is not present, and flow of the fluid 22 is not greater than a specified maximum flow rate (i.e., $Q<Q_{max}$ allowable), then flow through the flow control device 20 can be increased by decreasing restriction to flow through the flow control device.

The methodologies described above and in FIGS. 3 and 4 allow for maximizing production from a zone 14*a-c* of interest while preventing formation of unwanted materials in that zone. This methodology may be implemented for one, more than one, or all independently controlled zones in a well in order to maximize production from the well. Additionally, the method 30 may be modified by alternately cycling the flow control device 20 open and closed (instead of choking) in order to prevent or reverse the formation of the unwanted substances. The cycle times between open and close may be pre-determined on a time basis, or may be linked to observations of downhole pressure, temperature, and detection of the unwanted materials with the sensors 24.

The concepts of this system 10 using downhole sensors 24 for detecting the formation of unwanted materials may be also extended to implementation inside the production conduit 18 where flow streams from different zones 14*a-c* are commingled or mixed, particularly if, under certain conditions, and at particular ratios, the fluids 22 from different zones are chemically incompatible, the mixing of which can precipitate scales, paraffins, waxes, bitumens, asphaltenes, salts, or other solids which may cause plugging of the production conduit. This may be the case where reservoirs containing different fluids are commingled.

In this case, the control logic of the system 10 may adjust the relative proportion of contribution to flow of each of the zones 14*a-c* or reservoirs upon detection of the unwanted materials so that a mixing condition is established which does not promote the precipitation of the unwanted materials. This control process requires a good understanding of the nature of the fluids, the chemical processes which take place upon mixing, the chemical reaction dynamics, the type of materials precipitated, and the range of mixture conditions under which the unwanted materials form or do not form.

Phase can be defined as a thermodynamic state of matter.

The system 10 and methods 30 described more fully below can be effective to measure and detect the shift from single phase production to two phase production in a zone 14*a-c* of a producing well. In addition to detection, a flow control device 20 can be actuated to reduce the fluid 22 flow from a selected zone when two phase production or production of unwanted substance is detected.

The system 10 can also report flowing conditions and actions to a surface supervision control and data acquisition system, and finally shift production of fluids from the well's multiple producing zones 14*a-c* as needed to maximize the production of the preferred fluids. This process can be similar to field-wide production optimization (adjusting relative well-to-well production) by nodal analysis to optimize well production through interval allocation. The system 10 can utilize local detection by the sensors 24, and can take action based on current flowing fluids 22 properties.

The system 10 can achieve these results utilizing four elements: 1) fluid phase detectors (such as sensors 24), 2) an induced pressure drop, 3) a mist concentrator, and 4) an actuator operative to at least shut off flow, however throttling or choking capability is preferred. A control algorithm commands the opening and closing and/or flow restriction through the flow control device 20.

Figure 5:
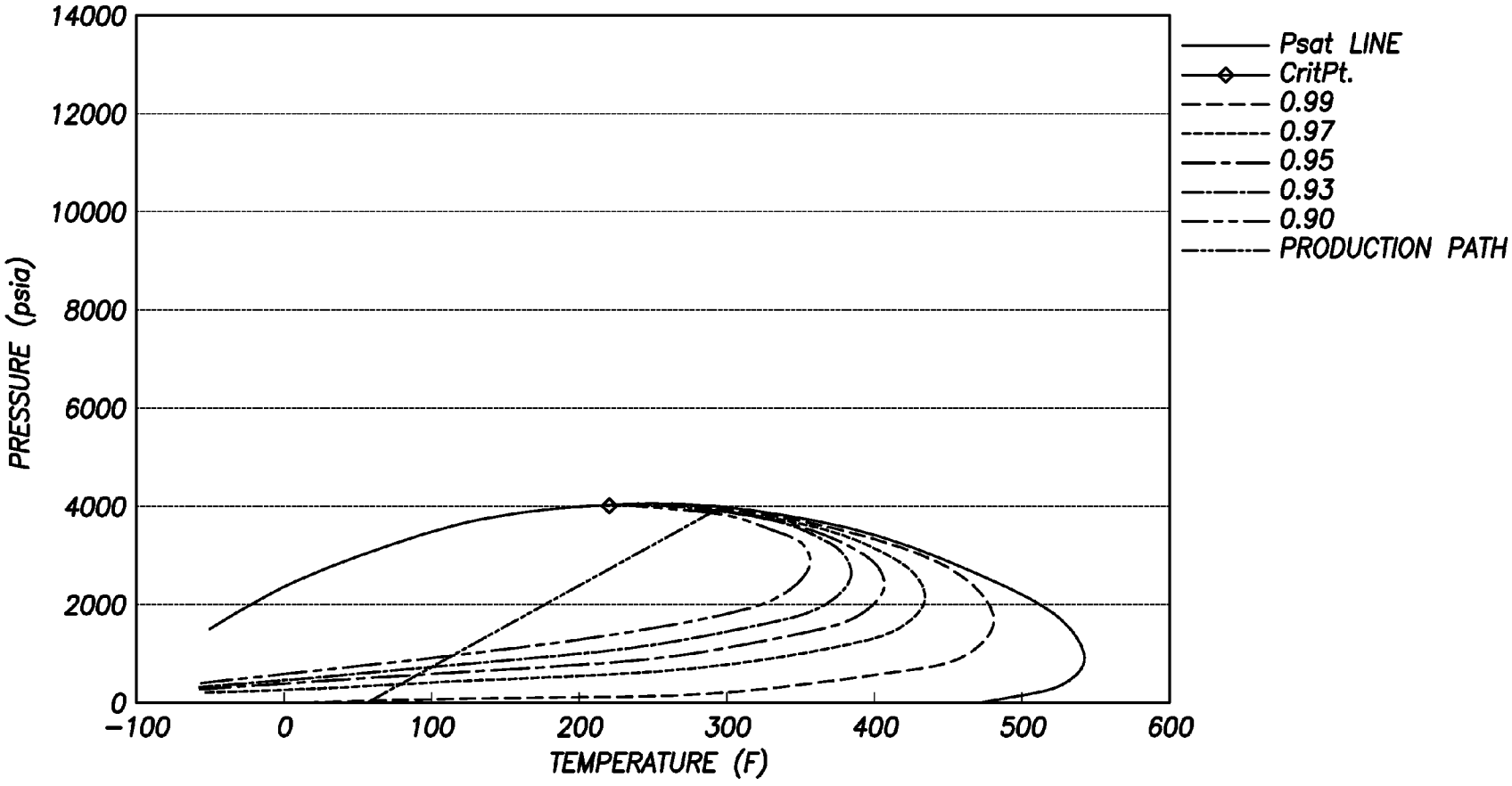
FIG. 5 is a graph of gas condensate phase envelope with volume fractions.

A model of the fluid 22 phase behavior (PVT properties) will improve the overall control and error detection. A graph of gas condensate phase envelope with volume fractions is provided in FIG. 5.

The fluid systems supported are the single phase systems where during production, first the near wellbore 12 and then the total reservoir pressure will fall below the dew point or bubble point line (depending on reservoir composition temperature and pressure.) In this example, the fluid 22 is a sample from a gas condensate reservoir. The reservoir containing the fluid 22 example of FIG. 5 will produce a single phase into the wellbore 12 until the local pressure falls below 3939 psia, the dew point ($P_{sat}$), at the reservoir temperature, 293 degrees F. ($T_{res}$). Formation pressure will be indicated as $P_{form}$.

The pressure field around the wellbore 12 is generally a function of static, dynamic, and geometrical considerations. The simplest case is a homogeneous reservoir with a round vertical wellbore 12. In this case the behavior of the fluid 22 is driven by the drawdown pressure, and then the behavior of the system 10 limits the flow into the wellbore 12.

The gas flowing into the wellbore 12 will expand (if the Joule-Thompson coefficient is positive), the fluids 22 will cool, and this will drive the viscosity of the system down (liquids increase). The system in this illustration has a negative Joule-Thompson coefficient until the interval between 6000 and 7000 psia where it switches to positive, cooling begins, and viscosity of the gas is driven down. This underscores the advantage of having PVT data to build a model for optimum flow conditions. The pressure field is generally simpler than for fractured horizontal wellbores.

Figure 6:
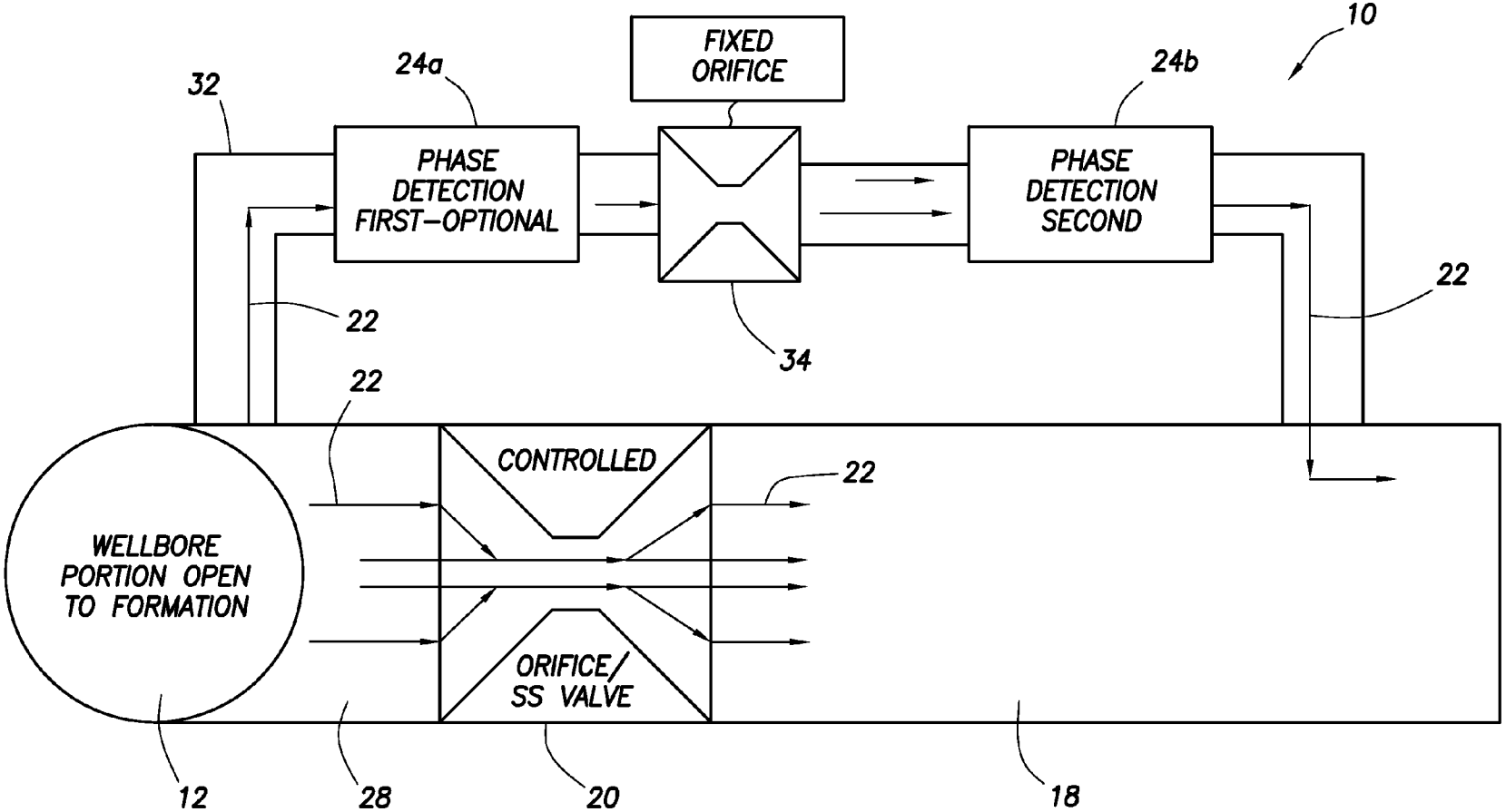
FIG. 6 is a representative diagram of a condensate sensing arrangement which may be used in the well system.

FIG. 6 depicts a relatively simple implementation which may be used with the system 10. The lower portion of FIG. 6 schematically illustrates flow of the fluid 22 from the wellbore 12, into the annulus 28, and via the flow control device 20 into the production conduit 18.

A bypass passage 32 allows a portion of the fluid 22 to flow from the annulus 28, through phase detection sensors 24*a,b* and a fixed orifice 34, to the production conduit 18. In one example, the PVT model (e.g., such as that depicted in FIG. 5) is used to estimate a virtual state of the fluid 22 phase behavior. This virtual state is used as the control parameter in the system 10 for regulating adjustment of the flow control device 20.

Figure 7:
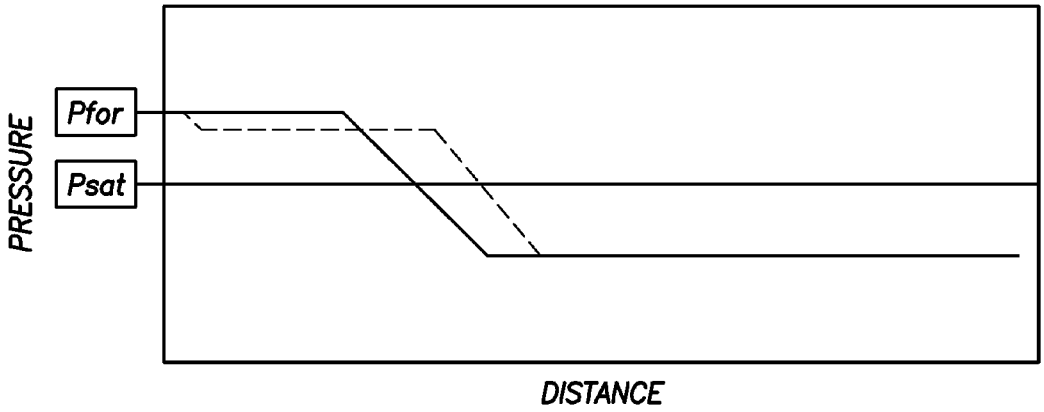
FIG. 7 is a representative graph of pressure vs. distance in the condensate sensing arrangement of FIG. 6.

FIG. 7 is a representative graph of pressure vs. distance along the flow paths of the system 10 of FIG. 6. The vertical axis is pressure and the horizontal axis is position within the flow lines of the instrument.

The solid and dashed lines reflect pressures in the two different flow paths. The solid line represents pressure in the main flow path through the flow control device 20. The dashed line represents pressure in the flow path which extends through the sensors 24*a,b*.

Both flow paths start at the formation pressure ($P_{for}$) and decrease to pressure in the production conduit 18 (unlabeled). If pressure in either of the flow paths decreases to saturation pressure ($P_{sat}$), condensate will begin forming in the fluid 22.

The flow path represented by the solid line in FIG. 7 extends through the flow control device 20, which creates a pressure drop. The flow path represented by the dashed line in FIG. 7 extends through the bypass passage 32 and has two pressure drops.

By looking at the flow in the bypass passage 32 at a location between the two pressure drops, a determination of whether condensation in the formation 26 is imminent can be made. As long as the pressure plateau (between the two pressure drops) in the dashed line is above the saturation pressure ($P_{sat}$), then no condensation in the formation 26 is indicated. Thus, the system provides advance warning of the onset of condensation in the formation 26.

Various different properties can be detected by sensors 24*a,b* to indicate phase of the fluid 22 in this example. Saturated fluid properties differ at all conditions except the critical point. Density, viscosity, speed of sound, heat and heat transport properties including Joule-Thompson Coefficients, heat capacity and thermal conductivity, optical properties including scatter refractive index, and color are examples of properties which can be used to detect phase.

A vibrating tube density measurement device has proven to be very sensitive to heterogeneous samples. This device as implemented in the RDT™ and GeoTap™ tools marketed by Halliburton Energy Services, Inc. of Houston, Tex. USA utilizes a tube in resonant vibration. The resonance condition is maintained utilizing the tube as the reference oscillator in its fundamental mode of transverse vibration. The positioning of drive and pickup magnets on the body of the tube fixes the vibration length and order. A homogeneous fluid 22 flowing through the tube maintains a constant mass distribution. A denser fluid 22 results in a lower system frequency.

When a non-homogeneous fluid 22 flows through the tube, the tube and the flowing fluid can fall out of the required fundamental oscillation mode resulting in a loss of drive and often a rather wide range of positive feed back frequencies. In many systems the fluid segregates are enough to define an operating envelope for the two fluids flowing through the tube.

A preferred implementation is to use two densitometers (sensors 24*a,b*), one densitometer upstream and the other downstream of a fixed orifice 34. The section between the orifice 34 and the downstream densitometer (sensor 24*b*) may have mist collectors installed to separate fog and preferentially channel the flow to one side of the downstream densitometer (e.g., wall flow, perhaps gravity stabilized). This segregation of the fluids increases the sensitivity of the system. The mist collectors or fog separators can be demisting pads, structured packing, cyclone separators (high velocity), or horse tails of hydrophobic fibers which collect and agglomerate oil droplets from the flowing gas stream (a preferred embodiment).

In an under-saturated oil system the minority phase to be separated may be gas and the preferred heterogeneous path would be a bubble train along the upper surface of a horizontal densitometer flow tube.

In an oil-water system, the horse tail approach can indicate very low oil flowing fractions (e.g., 1 part oil in 5000 parts water volumes). This approach is akin to an oil film of a pond.

In an EOR (Enhanced Oil Recovery) application, the solvent density at breakthrough is a well known target. At this target the system 10 would close, or at least significantly restrict flow through, the flow control device 20 (e.g., shift a sliding sleeve or variable slot sliding sleeve valve to off).

Figure 8:
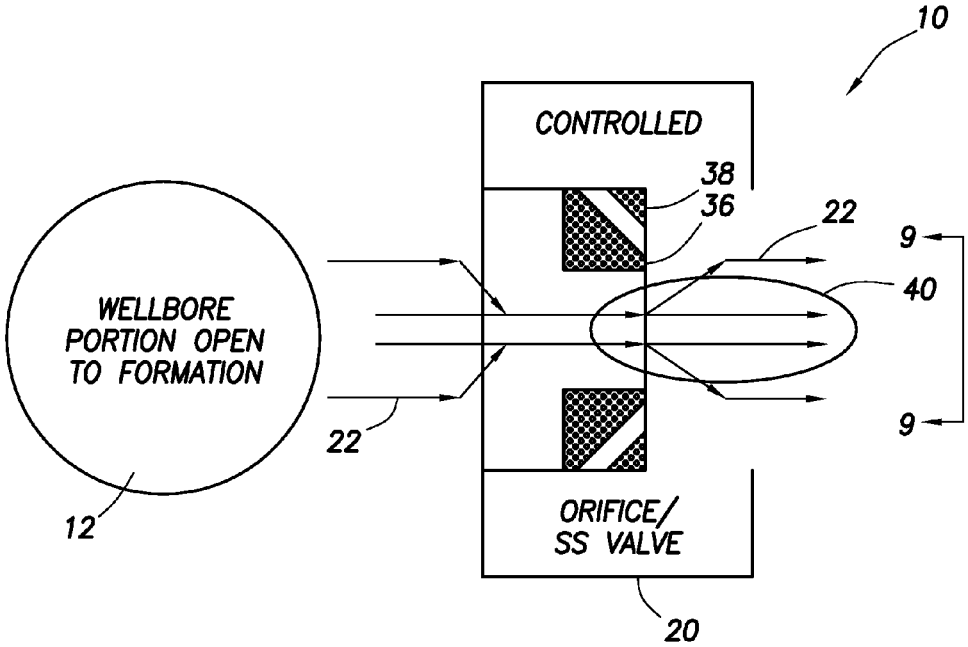
FIG. 8 is a representative diagram of a gas condensate sensor.

Alternative Detector:

Optical detection in a gas system can be arranged as described below and representatively illustrated in FIG. 8. A light path would be concentrically directed along the axis of the flow control device 20 on the downstream side. Optical fibers 36 in a ring are directed to a focus area 40 just downstream of the flow control device. A portion of the fibers 36 are returned to a detector for measuring reflected light, while the remaining fibers 38 are used for illumination. (Illuminator might be a flash system, duty cycle would allow for very low sourced power levels.) Illumination and observation system is similar to dark-field illumination in microscopy. The focused illumination and the distance to other reflectors provides for very low background intensities. A signal occurs when scattering or reflecting particulates are flowing through the axis of the system 10.

Detection is similar to fog in headlights, this provides detection in systems with very low liquid ratios. The location of the detector just downstream of the flow control device 20 takes advantage of any Joule-Thompson cooling to amplify the sensitivity of the system 10. (The inversion temperature and pressure for the Joule-Thompson Coefficient is usually above the dew point of the fluid 22. The fluid 22 cools as it flow through the flow control device 20. This tends to increase the liquid ratio of condensates.)

Figure 9:
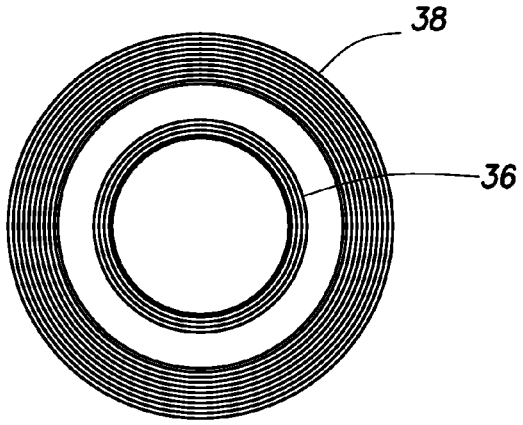
FIG. 9 is an end view of the sensor of FIG. 8.

As depicted in FIG. 9, a second ring of fibers 38 allows for separate detection and illumination.

A simple case in point, water vapor in air. This effect will also happen in "dry gas" when the water is salt free, distilled as it were. If the system 10 is at 77 degrees F. and 1 atmosphere, density at 100% relative humidity is 1.16697 gm/liter. Density at 99% relative humidity is 1.13711 gm/liter. Water vapor is 18/28.966 lighter than dry air.

The volume is strikingly small which works out to around 30 microliters total liquid volume per liter of gas. This liquid is further distributed as an aerosol and is seen as fog.

These fine homogeneous systems can use some form of concentration for quantitative measurement of the liquid phase. Detection is significantly easier when the liquid phase particles are concentrated.

Applications for this technology include at least:

- Production of gas condensate wells with multiple intervals or multilateral completions.
- Optimizing the total production of the well.
- Production of under saturated oil reservoirs, modulating the production of intervals to maintain a reservoir pressure in the near wellbore area of an interval just above the saturation pressure.
- Optimizing oil production and minimizing gas handling at surface.
- Allowing the production of intervals in close proximity to a fluid/fluid contact, by controlling the production of the preferred fluid to keep water or gas cones from forming. These are situations which are driven by differential pressure in the near wellbore area.
- In Enhanced Oil Recovery, detection of gas or water at breakthrough in an enhanced oil recovery or $CO_2$ sequestration project. Shutting off "thief zones" at the producing well, the shut in interval will deflect flow of the solvent or water to improve sweep efficiency.

A dew point sensor may be used for the sensor 24 in the system 10. A purpose of this sensor is to locally promote conditions that would produce dew from a gas mixture by changing the pressure and the temperature. Once the conditions at which dew is produced have been identified, the flow rate and pressure of the system 10 can be adjusted to operate outside of these conditions (thereby preventing condensation in the fluid 22).

In the case of water vapor, the dew point is the temperature to which a given parcel of air must be cooled, at constant barometric pressure, for water vapor to condense into water. The condensed water is called dew. The dew point is a saturation point.

In our case, the interest is in detecting the dew point of a hydrocarbon gas mixture in order to maintain the production of the mixture in the gas phase. Two of the parameters that will promote the production of dew are reduction of pressure and reduction of temperature.

Figure 10:
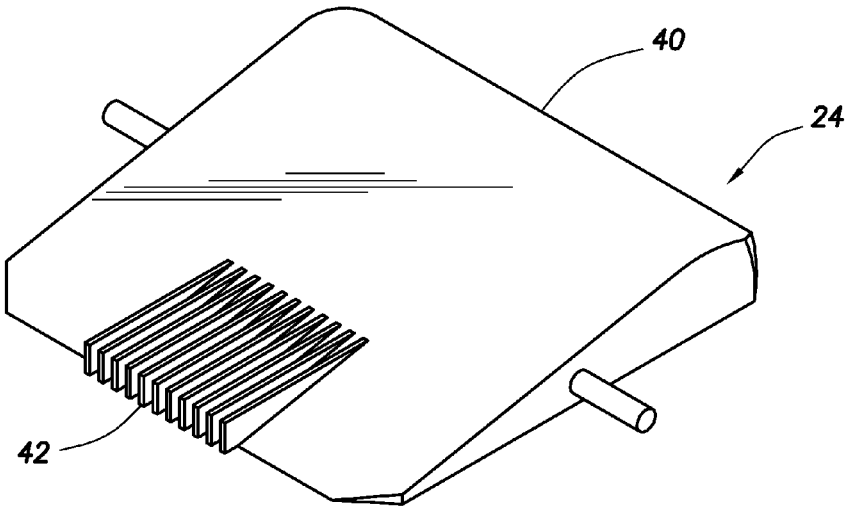
FIGS. 10-13 are views of another configuration of the sensor.
Figure 11:
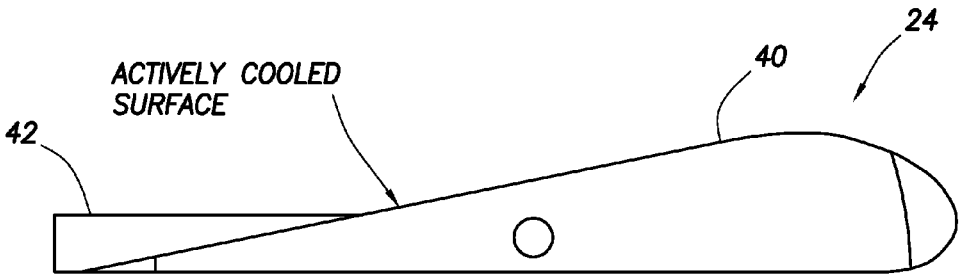

The method used here can apply a known aerodynamics concept to produce a low pressure/high flow rate and a high pressure/low flow rate condition. In addition to adjusting the pressure, the surface of a wing 40 (see FIGS. 10 & 11) or venturi (e.g., the orifice 34) can be actively cooled using a Peltier cooler. A Peltier cooler, heater, or thermoelectric heat pump is a solid-state active heat pump which transfers heat from one side of the device to the other side against the temperature gradient (from cold to hot), with consumption of electrical energy. Such an instrument is also called a Peltier device, Peltier heat pump, solid state refrigerator, or thermoelectric cooler (TEC).

Figure 12:
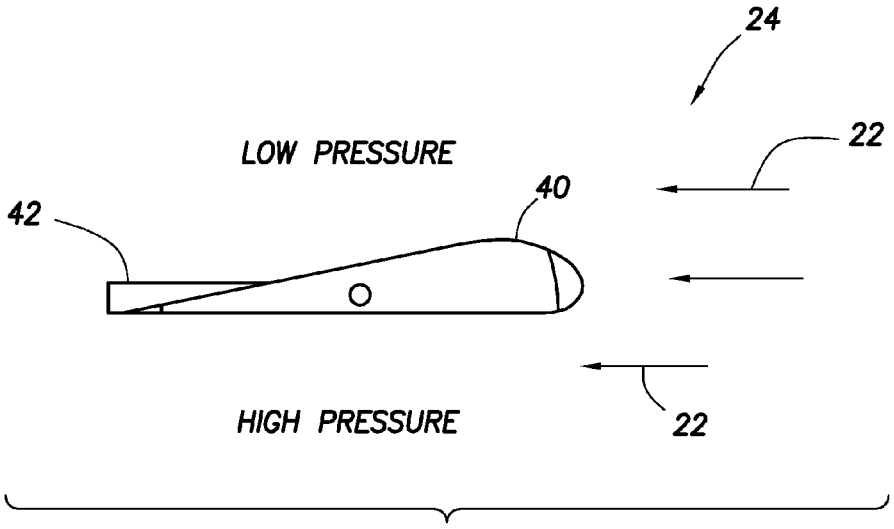
Figure 13:
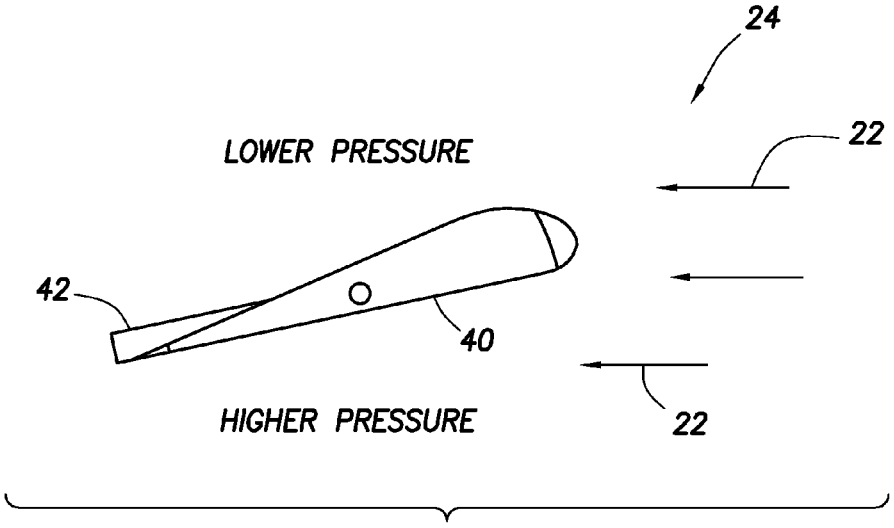

As depicted in FIGS. 12 & 13, an angle of the wing 40 relative to flow of the fluid 22, or size of the venturi inside the pipe, can be varied to create a region with the desired pressure of another portion of the flow stream (for instance, to simulate flow inside the formation 26) or to create a margin of safety so condensation occurs within the sensor 24 well before it occurs in the ambient flow stream. Both ambient and altered pressure (above the wing 40 or in the venturi) would be monitored.

The Peltier cooler can be activated to reduce the temperature of the top surface of the wing 40 or within the venturi. Preferably, the temperature of the wing 40/venturi is also constantly monitored at one or more locations.

If dew is produced, the droplets will flow toward the tail of the wing 40 and through conductive plates or other types of electrodes 42. By measuring the resistance, inductance or conductance of the fluid 22 at that location, the presence of condensate can be ascertained.

Once the required parameters to produce dew have been identified, the production flow rate is adjusted to operate outside of that zone and keep the hydrocarbons in gas phase.

This example of the sensor 24 uses a wing 40 or variable venturi to reduce the pressure of the ambient flowstream at the sensor, so the sensor can alert to impending condensing conditions before that condition is actually reached. The angle of the wing 40 can be changed so the sensor 24 can recreate the flow conditions in a different part of the flowstream (for instance, in the formation 26 outside of the wellbore 12), but still using a sample of the same gas that exists in the zone 14*a-c* of concern.

The sensor 24 allows for detection of impending condensing conditions within a producing gas well or subsea pipeline. Flow rates, temperatures, or other controllable variables could then be varied as needed to prevent damaging condensate from forming within the flow line or nearby formation 26.

Gas condensate control is beneficial for near wellbore 12 permeability health in dry-gas wells.

Sensors 24 with fully distributed condensate acoustic noise detection, location and characterization along the full wellbore can be used for real-time flow control feedback to minimize condensate production (as in the method 30 of FIG. 4).

A very simple and unique "closed optical path" distributed acoustic singlemode optical fiber-based sensing method and apparatus can be used to reliably and, most importantly, "remotely" and "passively" (no downhole electrical power) detect condensate formation and track its migration within the wellbore 12.

Condensate noise detection, location, and characterization preferably provides real-time feedback for control of production flow rates to minimize or eliminate condensate-formation, and to better ensure prolonged wellbore production health.

Having the ability to simply "listen" to and "characterize/classify" suspicious acoustic emissions above normal acoustic background, at any desired location along the wellbore 12, should facilitate early detection and location of condensate formation.

Real-time permanent acoustic noise information and localization of liquid noise dynamics such as: gurgle, slip back, jetting, bubble acoustic spectra, etc., allows for real-time control of the flow control devices 20 to reduce flow rates in specific zones 14*a-c* or at surface in an effort to minimize or eliminate such anomalous point noise magnitudes.

To eliminate gas condensate precipitation, a goal may be to optimize local in-well PVT conditions indirectly, without actually knowing local in-well pressure or temperature, based solely on the ability to variably restrict total or zonal flow(s) to minimize liquid noise magnitudes. This method assumes prior or learned calibration of acoustic energies, based on characteristic acoustic spectra, which contain much lower frequency bandwidth content for liquid dynamics compared with higher frequency bandwidth content of dry expanding gas dynamics.

This system and method uses a relatively new optical fiber-based distributed acoustic sensing technique and apparatus to detect, locate and characterize condensed liquid slug and bubble "gurgle" flow noise produced remotely within "dry" gas producing wellbores.

A preferred embodiment involves disposing a downhole cable which houses and protects one or more singlemode optical fibers within a wellbore. The cable can be used for the sensor 24 in the system 10.

Figure 14B:
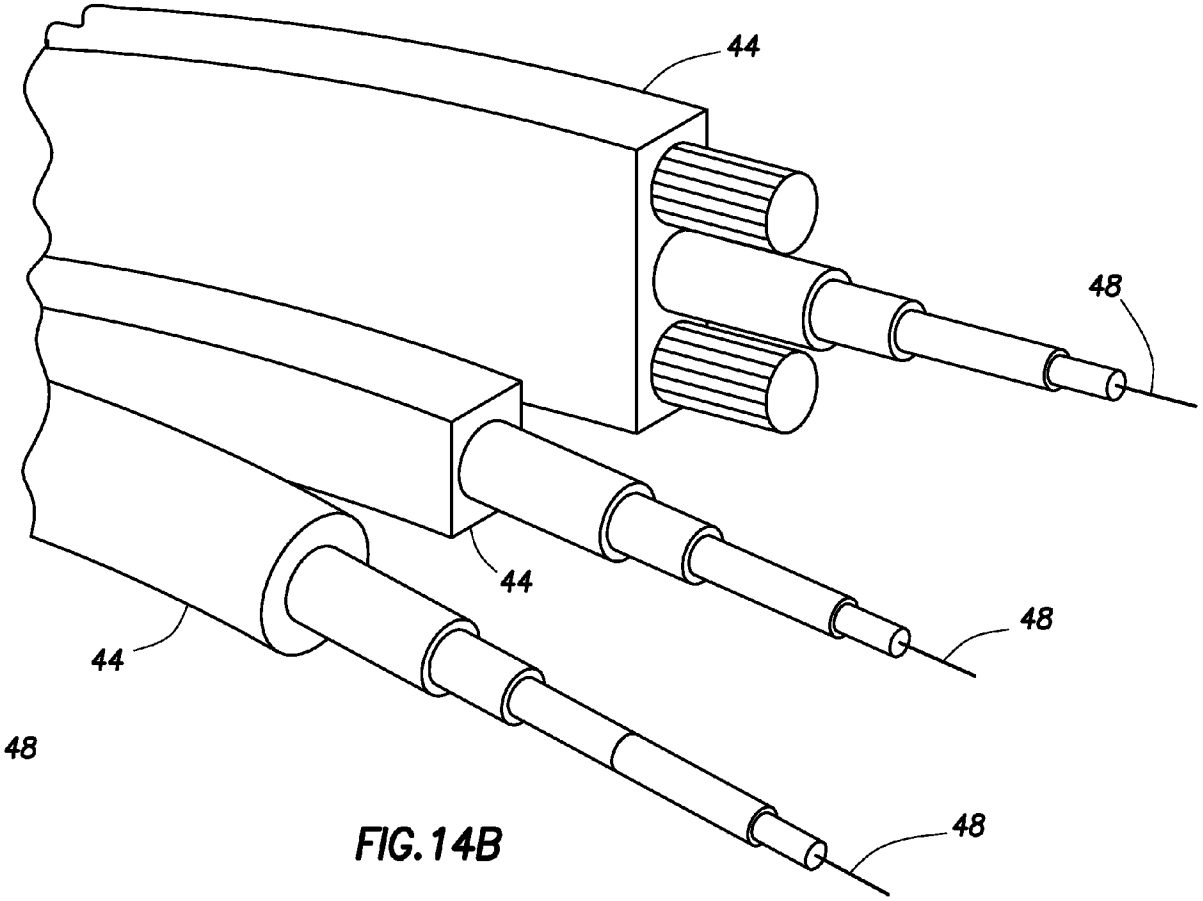
FIGS. 14A & B are views of optical configurations of the sensor.
Figure 14A:
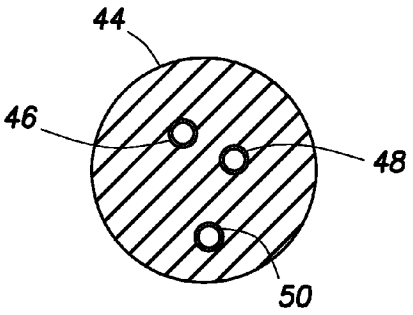
Figure 15:
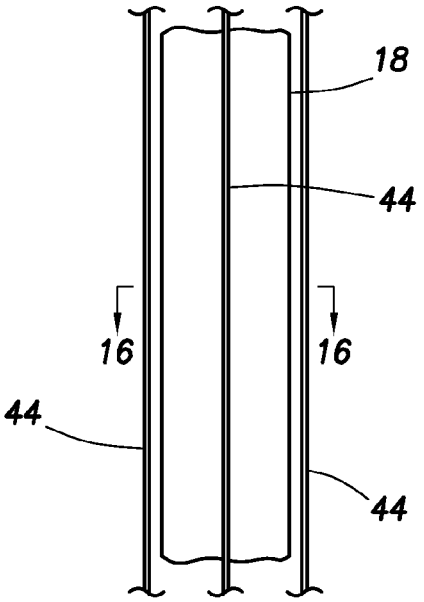
FIGS. 15-20 are view of various techniques for positioning the optical sensors in a well.
Figure 16:
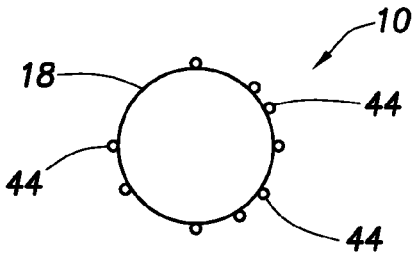
Figure 17:
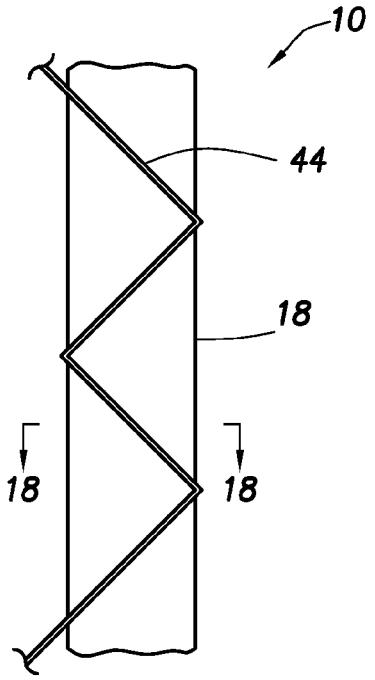
Figure 18:
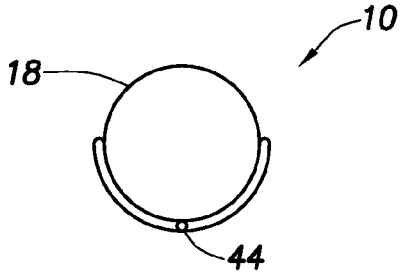
Figure 20:
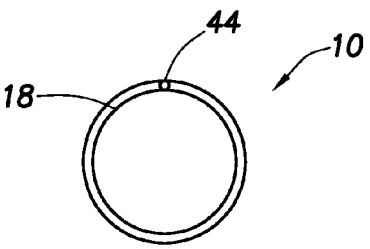
Figure 19:
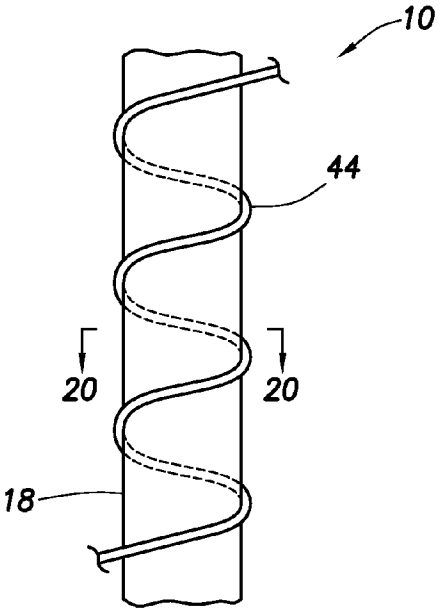

A cable 44 depicted in FIG. 14A includes a temperature sensing fiber 46 (for distributed temperature sensing), an acoustically sensitive fiber 48 (for distributed acoustic sensing), and a hydrogen sensing fiber 50 (for distributed hydrogen sensing). Alternate cable 44 shapes are depicted in FIG. 14B. The cable 44 may be attached at the surface to an ultra-narrow linewidth laser-based interferometric signal interrogator (optical transceiver, not shown) for making said continuous measurement of distributed acoustic noise disturbances along said fiber 48.

Said cable 44 may be placed behind casing (e.g., within cement) or along production conduit 18 within annulus 28. In some cases, the fiber cable 44 may be placed directly inside the production conduit 18 temporarily or permanently.

A preferred embodiment employs one or more optical fibers 48 to detect acoustic pressure changes (dynamic pressures) and shear/compressional vibrations along the fiber, which may be disposed linearly or helically along the wellbore 12. The helical or "zig-zag" cable 44 deployment will improve system 10 spatial resolution by effectively increasing fiber-to-wellbore length ratio (instead of the typical 1-to-1 ratio). Examples of such helical or zig-zag cable 44 deployment are depicted in FIGS. 15-20.

Another embodiment comprises an extended continuous fiberoptic hydrophone or accelerometer, whereby the acoustomechanical energy is transformed into a dynamic strain along the fiber 48. Such strains within the fiber 48 act to generate a proportional optical path length change measurable by various techniques, such as interferometric techniques (including a preferred technique using Coherent Rayleigh Backscatter), polarimetric, Fiber Bragg Grating wavelength shift, or photon-phonon-photon (Brillouin scattering) frequency shift within light waves propagating along singlemode fiber sensor 24 length.

Such optical path length changes result in a similarly proportional optical phase change or Brillouin frequency/phase shift of the light wave at that distance and time, thus allowing remote surface detection and monitoring of sound amplitude and location continuously along the optical fiber 48.

Figure 21:
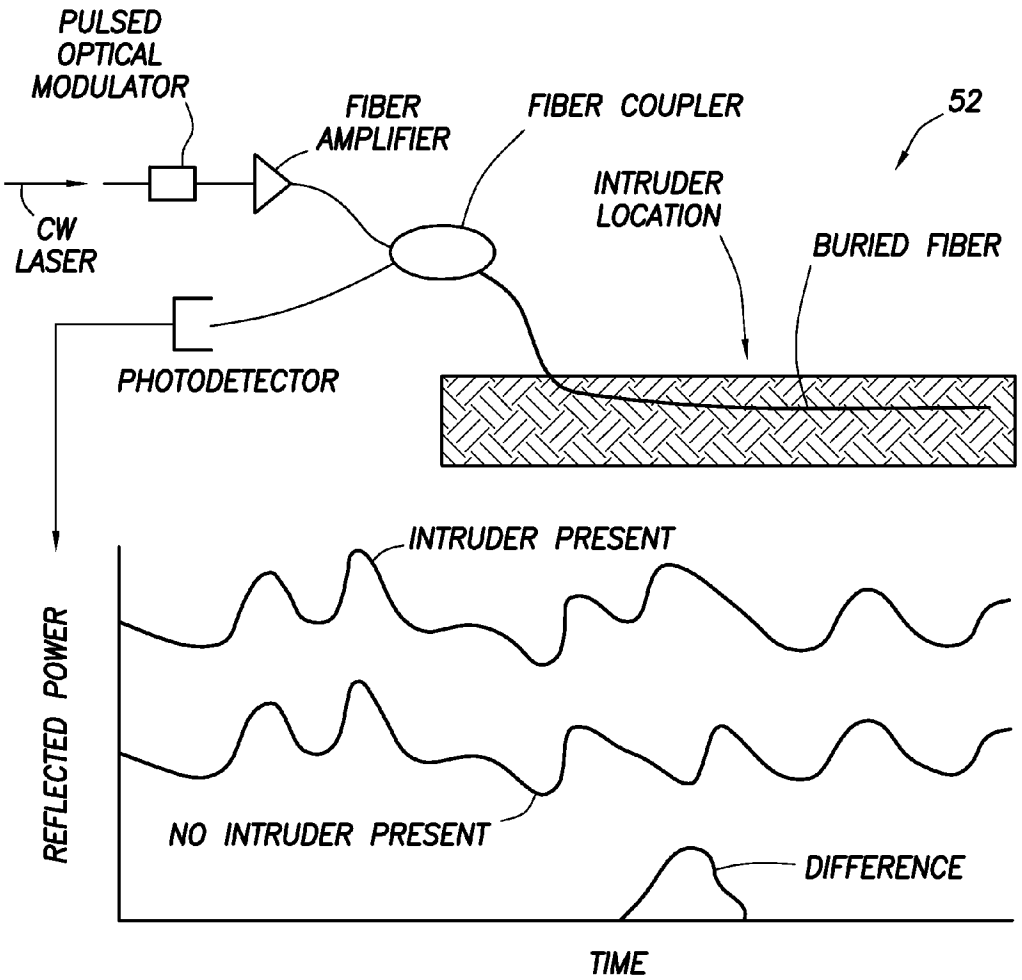
FIG. 21 is an optical sensor system schematic and a graph of optical power produced by the system.

In FIG. 21 is depicted a typical fiber circuit 52 for Coherent (or phase) Rayleigh backscatter based distributed acoustic sensing or distributed vibration sensing (DAS or DVS). Also depicted in FIG. 21 is a graph of reflected optical power vs. time, for two situations. In one situation, no specific acoustic or vibrational disturbance is present, so the reflected optical power can be considered background noise. In the other situation, a specific acoustic or vibrational disturbance is present, so the difference between the reflected optical power and the reflected optical power in the prior situation indicates the presence and location of the disturbance.

FIGS. 22A-26 are derived from L. Thevenaz, "Review & Progress in Distributed Fiber Sensing," Ecole Polytechnique Federale de Lausanne, Laboratory of Nanophotonics & Metrology, Lausanne, Switzerland.

Distributed sensors can be classified as linear or nonlinear. Position resolution for linear distributed sensors is by detection of elastic or inelastic backscatter. For nonlinear distributed sensors, position resolution is by parametric process.

In the time domain, the activating signal is a propagating pulse, and the position is given by the time of flight. Spatial resolution is given by the pulse width. This is most suitable for long range and meter spatial resolution.

In the frequency domain, the activating signal is a frequency-swept CW (continuous wave); the backreflected signal is combined with a locally reflected signal. The beat frequency gives the position; spatial resolution is obtained by Fast Fourier Transform. The coherence length is greater than the range. Spatial resolution is given by the sweeping rate. This is most suitable for short range and millimeter spatial resolution. Alternative techniques include an RF modulated source, OLCR, and synthesized correlation.

Figure 22A:
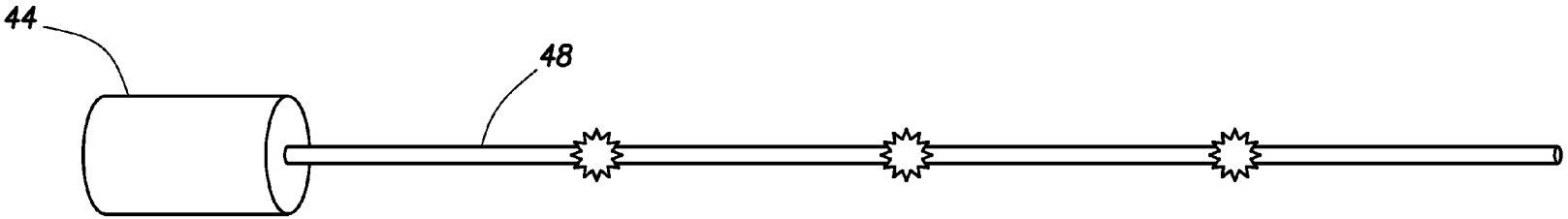
FIGS. 22A & B are views of the optical sensor and installation of the sensor with a casing.

In FIG. 22A, the fiber 48 combines two functions: a sensing element (usable as the sensor 24 in the system 10) and signal propagator.

Figure 22B:
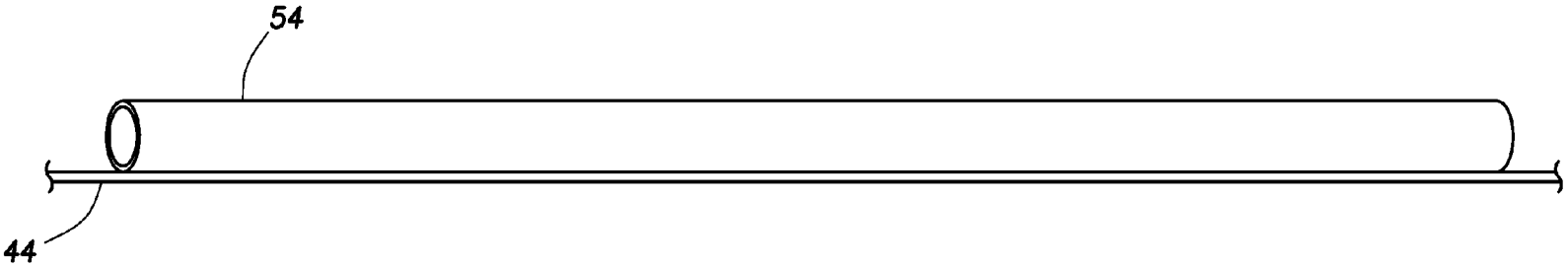

In FIG. 22B, the cable 44 can continuously inform about acoustic disturbances and vibrations in a larger structure, such as casing 54, production conduit 18, cement, annulus 28, etc.

Figure 23B:
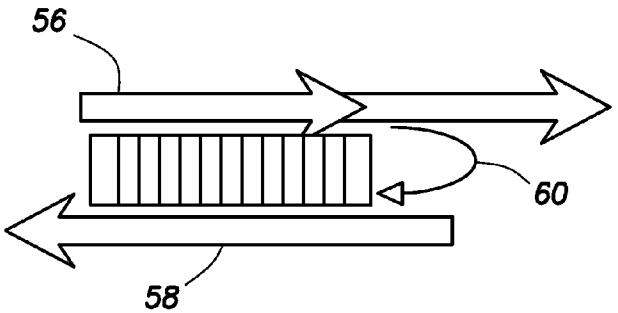
FIGS. 23A & B are representative depictions of linear and nonlinear sensing arrangements.
Figure 23A:
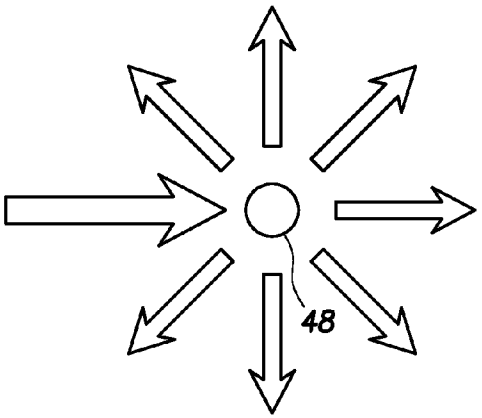

In FIG. 23A, for linear distributed sensors, a small fraction of the scattered light is coupled back into the fiber 48, similar to a continuously distributed reflection.

In FIG. 23B, for nonlinear distributed sensors, two counter-propagating waves 56, 58 are coupled through a nonlinear interaction involving a third idler wave 60.

Figure 24A:
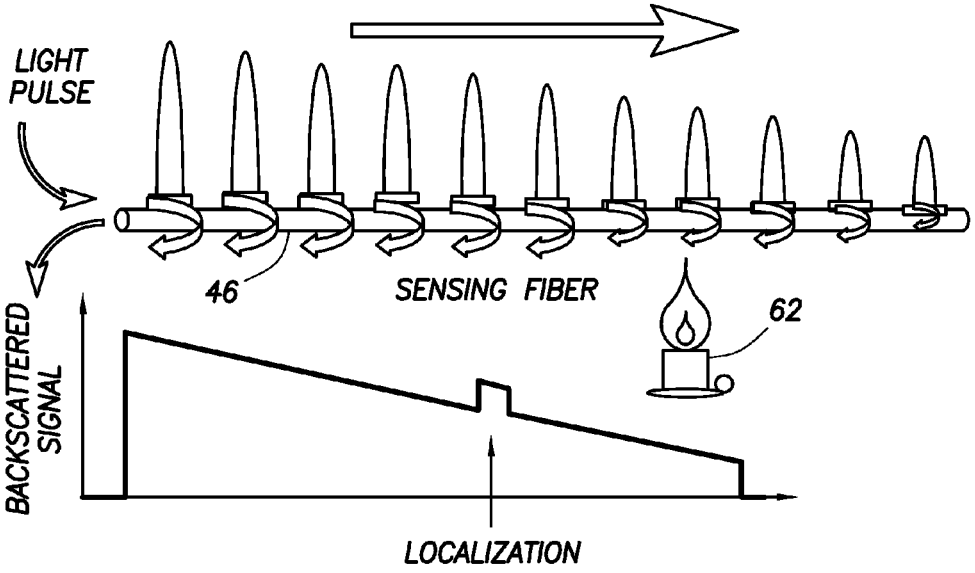
FIGS. 24A & B are representative depictions of linear and nonlinear sensing fibers and corresponding graphs of optical power.

In FIG. 24A, for linear distributed sensors, the position of a stimulus 62 (in this case a temperature anomaly) is indicated by a change in amplitude of a backscattered optical signal.

Figure 24B:
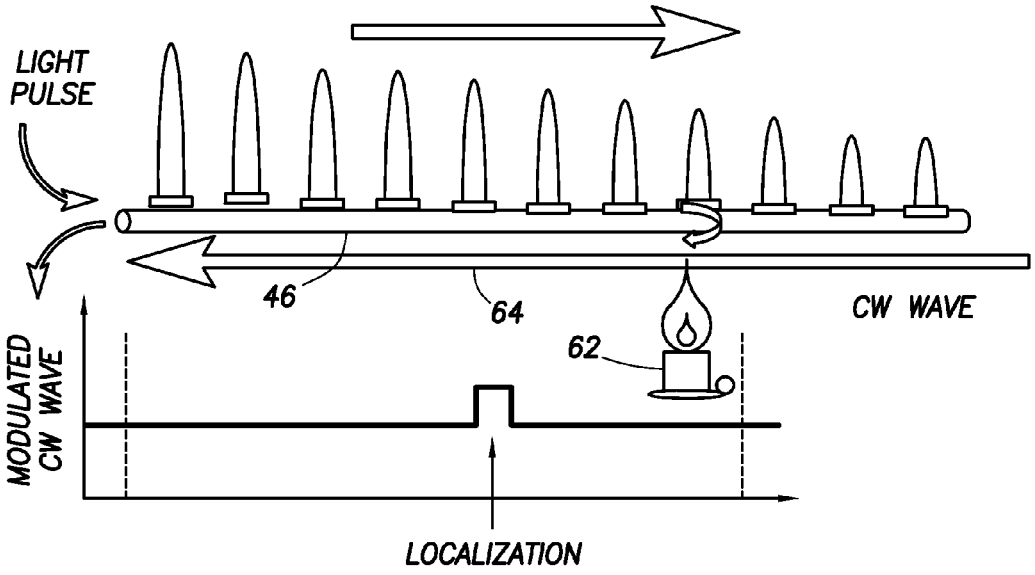

In FIG. 24B, for nonlinear distributed sensors, the position of the stimulus 62 is indicated by a change in optical power amplitude of a continuous wave 64 counter-propagated through the fiber 46.

Figure 25:
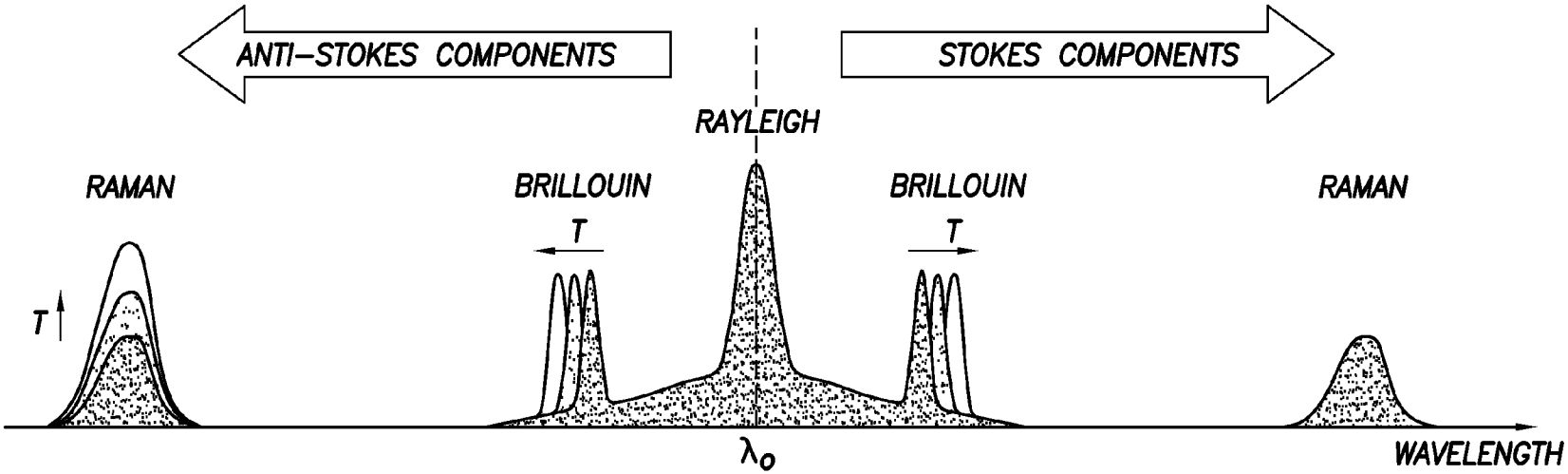
FIG. 25 is a representative graph of various types of optical backscatter.

FIG. 25 illustrates various types of optical backscatter used for sensing applications. Rayleigh backscatter is a pure distributed reflection with random amplitude. For Raman backscatter, the amplitude of the backscattered optical signal is temperature dependent. Brillouin backscattering is both temperature and strain sensitive.

Figure 26:
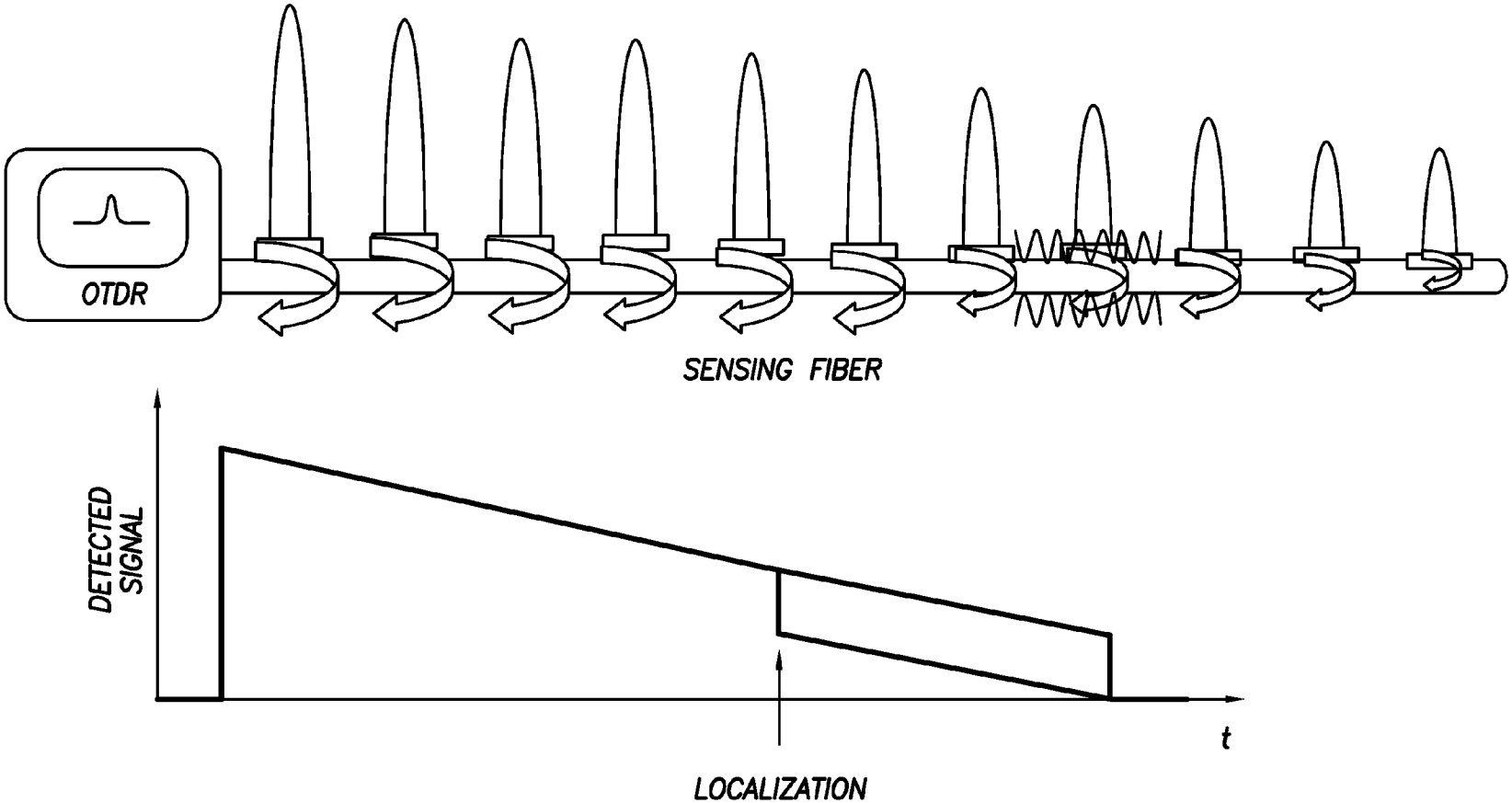
FIG. 26 is a representative depiction of a distributed acoustic sensing system and a graph produced by the system.

FIG. 26 illustrates Rayleigh distributed sensing. The scattering coefficient is poorly dependent on external qualities. Rayleigh distributed sensing can be used by inducing a loss depending on an external quality (such as, microbending, evanescent field, etc.). Some advanced configurations can be based on polarimetry and coherent backscattering.

The basic principle of operation makes use of coherent (or Phase, $\phi$) Optical Time Domain Reflectometry although it is contemplated that Optical Frequency Domain Reflectometry (OFDR), via Fourier transform techniques, also apply. To differential coherent OTDR techniques, ordinary incoherent OTDR techniques are regularly employed throughout the telecommunications and oil/gas industries today for optical signal transmission diagnostics and characterization.

In the $\phi$-OTDR technique, a light pulse of width $\tau$ is coupled into the fiber and the backscattered light is converted to an electrical signal of duration T, where $T=2L(n_g c)$, with L the fiber length, $n_g$ the group refractive index for the fiber mode, and c the free-space speed of light. For a silica fiber with $n_g=1.46$, it is calculated that T=9.73 L, with T in μs and L in km. Thus, for a 20 km fiber, the duration of the return signal is 195 μs. A signal processor for analyzing the $\phi$-OTDR data will digitize the return signal at a sampling rate $1/f\tau$, with f a constant <1. Thus, if $\tau=1$ μs and f=0.5, the sampling rate would be 2 MHz.

An analytical model used for predicting the $\phi$-OTDR performance assumes that the Rayleigh backscattering originates from a large number of "virtually reflective" centers.

These "virtual mirrors" within the fiber define a continuum of "two-beam" Fabry-Perot cavities within the fiber with equal scattering cross-sections, randomly distributed at locations {Zm} along the fiber. It is assumed that the light source is monochromatic at typical near infrared wavelengths which only excite singlemode light propagation, such as those wavelengths in the range from about 1480 nm to 1625 nm, and that the laser modulator passes a square pulse of width T for time domain measurements, or $1/\tau$ for frequency domain measurements.

A reference source is Choi, K. M., Juarez, J. C. and Taylor, H. F., "Distributed fiber-optic pressure/seismic sensor for low-cost monitoring of long perimeters."

Prior history on this topic deals with point sensors employed for temporary acoustic logs, rather than for permanently installed fully distributed real-time flow noise monitoring. The proposed technique offers unprecedented less than 1-meter spatial resolution along the wellbore; literally, thousands of effective microphones continuously distributed along the wellbore 12.

The downhole "wet-end" fiber sensor cable 44 can be installed once for permanent monitoring, thus alleviating the need for wireline acoustic log intervention which may cause production delay or shut-in and may impede actual operation flow dynamics. This is a non-obtrusive acoustic noise monitoring method compared with traditional wireline methods for production enhancement.

Sensors 24 and methods 30 described herein can be used for the detection and, to the extent possible, quantification of the formation of condensates in wells and other subterranean lines (e.g., steam lines) used in the petroleum industry. The term "condensate" in this disclosure is understood to mean any liquid that forms from condensation of a vapor phase, specifically in a subterranean area that carries a gas or gas mixture.

Sensors 24 disclosed herein can use various fiber optic methods to achieve the goal of detecting presence of condensate. These devices can be used as stand-alone sensor systems, or can be integrated as part of a well production optimization system that includes flow control devices 20 and other control system components, for example, as in the system 10 of FIG. 2 and the method 30 of FIG. 4.

Furthermore, the condensates to be detected can be those present in the fluid 22 in the Pressure-Volume-Temperature (PVT) conditions prevalent in the flow line at the monitored location, or at modified PVT conditions intended to force the condensation. In the latter case, the sensors 24 can be part of systems that seek to determine the dew point of downhole mixtures, or can be part of systems that seek to keep production wells flowing in conditions where condensation does not occur.

It is desirable to be able to monitor for the presence of condensates at several locations along a subterranean line. Many of the devices disclosed here are particularly well suited for multi-zone 14*a-c* monitoring and how this may be achieved is indicated where it applies.

Consider a tubular line in which a gas is flowing and assume that this gas is made of at least one component that can condense to the liquid phase under certain conditions of pressure, volume and temperature. Let us consider a first condition in which all the components are in the gaseous phase. In general, in such a condition the distribution of the components in the gas will be uniform such that the measurement of any physical property will not depend on the precise location of the sensor 24 in the cross-section of the line or around its internal periphery.

If the conditions change, for example, if the composition of the gas changes, or the local temperature changes, or upstream or downstream flow rates or PVT conditions are changed, there will be situations that will induce the condensation of one or more components of the gas into a liquid phase. This change will result in a foggy mist being present in the gas (such as observed in the trailing vortices of an airplane), and droplets may form along the internal wall of the line and flow with the gas (such as the water drops that form on the passenger window of an airplane taking off). Sensors 24 described in this disclosure can detect by optical means the presence of this liquid either in the flowing mixture itself, along the internal wall of the flow line, or in a cavity in communication with the flow line where the liquid can accumulate.

A liquid has a higher density than the flowing gas and, therefore, has a higher index of refraction. Also, droplets, including those present in mist or "fog," scatter more light than a uniform gas. This scattering can be observed optically as an increased signal (detection of the scattered light itself) or a signal loss (attenuation of light transmitted through the mist).

In a natural gas well in which condensates can form, it will be the hydrocarbon species with molecules with the larger number of carbon atoms, as opposed to methane (which has only one carbon atom), that will condense first. Therefore, optical measurements that have significant differences in response between single-carbon and multi-carbon molecules can also be used to detect and quantify the presence of liquid components. Sensors 24 discussed in this disclosure can take advantage of those mechanisms to detect and, where possible, quantify the presence of condensates in the mixture at a single location, or at several locations along the flow line.

When multiple locations are to be monitored, one option is to run separate optical fiber cables for each location. This can rapidly increase the number of fibers if several zones 14*a-c* are to be monitored. However, for many sensors 24 described herein, Optical Time Domain Reflectometry can be used to cascade the sensors 24 to be monitored in series along one optical line. This works for measurements that are based on optical signal attenuation or from Fresnel reflection along the cable length.

Some of the desirable features of a downhole gas condensate sensor 24 include low cost, ease of installation and ease or operation. High sensitivity (being able to detect low concentrations of liquids, which also results in low "false negative" detection) is desirable, but also with good discrimination (meaning that condensation should only be detected when it truly occurs, without "false positive" errors). As mentioned above, the ability to monitor several zones 14*a-c* is desirable, but the total number of fibers 46, 48, 50 used is preferably minimized. The sensors 24 preferably work over a wide range of temperatures (with upper temperatures of 150° C. or higher), and have a long total operational life (5 years or longer) and minimal measurement drifts over this life time.

Figure 27:
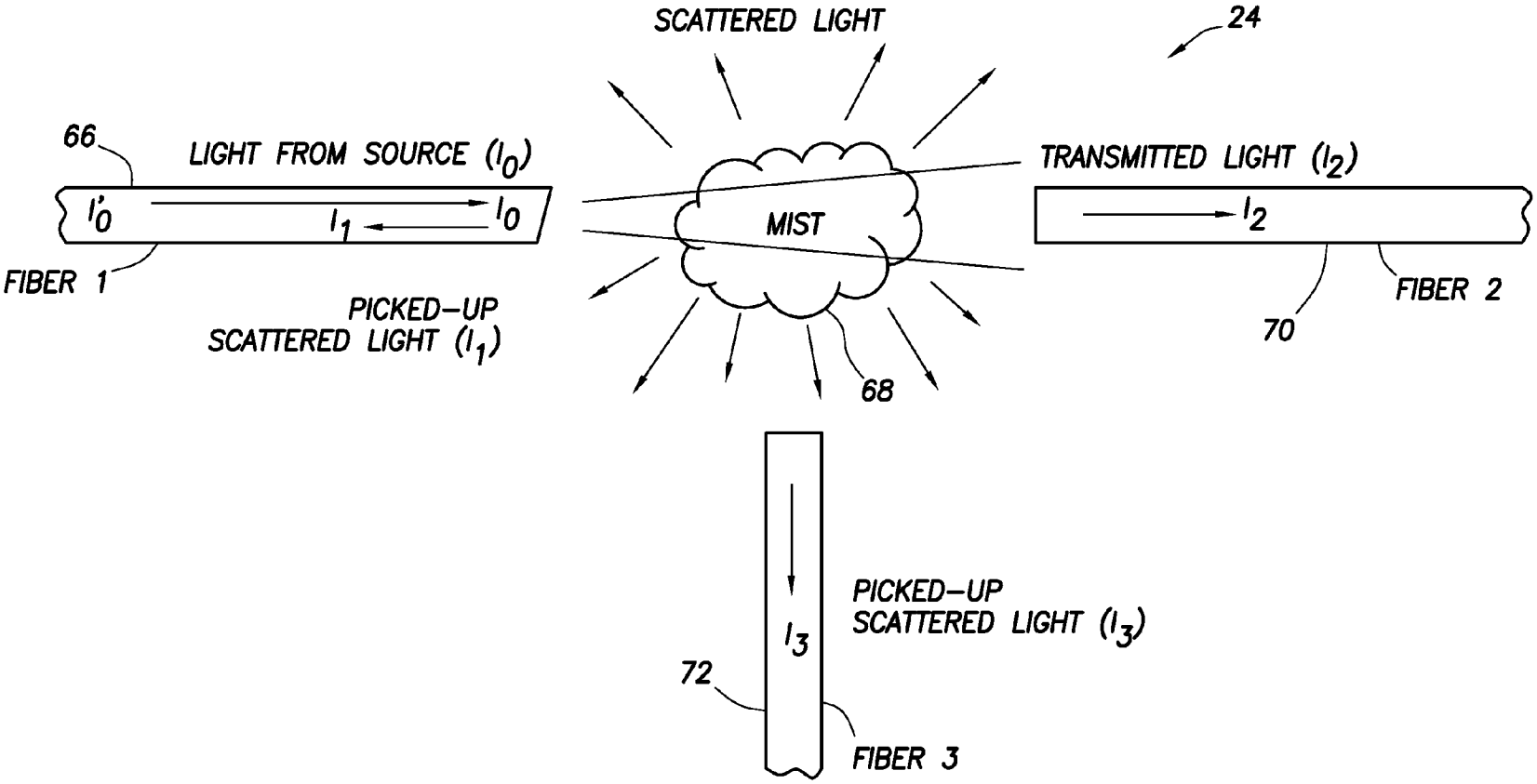
FIG. 27 is a representative depiction of an optical condensate sensor.

One series of sensors 24 is based on the detection of light scattered from the bulk gas/liquid mixture (called "mist" henceforth). There are several variations of how this can be implemented, but FIG. 27 representatively illustrates a general concept applicable to each of them. As depicted in FIG. 27, light is transmitted to the sensing location using an optical fiber 66. Light then exits the fiber 66 and interacts with the mist 68. Depending on the wavelength and power level of the light, and the sizes of the liquid droplets in the mist 68, several types of light scattering can occur.

Rayleigh and Mie scattering will always be present and are the most likely candidate for use in the sensor 24. Raman scattering, and laser-induced fluorescence are also possible alternatives. For the moment, Rayleigh and Mie scattering will be considered, which are both due to linear, elastic interactions, and produce light at the same wavelength as the source. They can be thought of as the conversion of a portion of the intensity from the original light beam (which propagates into a specific direction) into diffused light that is scattered in all directions. The angular intensity distribution of this scattering depends on particle size and light wavelength.

For Rayleigh scattering, the intensity I of light scattered by a single small particle from a beam of unpolarized light of wavelength λ and intensity Io is given by:

$$I = I_0 \frac{1+\cos^2\theta}{2R^2}\left(\frac{2\pi}{\lambda}\right)^4\left(\frac{n^2-1}{n^2+2}\right)^2\left(\frac{d}{2}\right)^6$$

Where R is the distance to the particle. O is the scattering angle, n is the refractive index of the particle, and d is the diameter of the particle. Whereas Rayleigh scattering favors the forward and reverse direction, the Mie scattering, which applies to larger particles (droplets), is predominant in the forward direction.

Also important in determining signal strength is the interaction length, or propagation distance in the gas/liquid mixture. The intensity of the forward propagating light decreases as a decaying-exponential with distance due to the attenuation of the mist 68. The side-scattered light, therefore, also decreases with increased distance from the source fiber 66.

Method 1.1: Transmitted Light Collected from Fiber 70 Opposite to Launch Fiber 66.

In this method, light $I_2$, transmitted to the fiber 70 is brought to a photodetector (not shown) and the intensity of the transmitted light is directly measured. The presence of condensation will be detected as a lower value for $I_2$, compared to the pure gas case. In most cases, a signal representative of the launched light ($I'_o=I_o$+loss due to transmission through fiber 66) will also be available and can be used to maintain $I_o$ constant or, alternately, to calculate $I_2/I'_o$. This will help improve sensitivity and discrimination.

Method 1.2: Scattered Light Collected Using Same Fiber as Launch Fiber 66.

Here the returned light $I_1$, is monitored. This light is dependant on the level of backscattering from the mist 68. Therefore the presence of mist 68 will result in a stronger $I_1$, signal. Note that fiber 66 is depicted in FIG. 27 as having an angled end at the sensing location and this will be preferred for this method. This is so that light reflected from the fiber 66/mist 68 interface does not reach the photodetector. Some means to measure $I_1$ can be located at the surface, with a fiber coupler or circulator being used to provide access to this light. A variant of this method is to also measure the transmitted light $I_2$ and to use $I_1/I_2$ as the monitored quantity. This provides improved sensitivity and discrimination due to the normalization signal. Note, however, that if the end of fiber 66 is angled and the end of fiber 70 is not, the relative angular position of these two fibers should be set so normal incidence occurs at fiber 70.

Method 1.3: Scattered Light Collected Using Fiber 72 Distinct from Launch Fiber 66.

In this method, a fiber 72 that is not on the same axis as fiber 66 is used to collect scattered light. (For example, Fiber 3 in FIG. 27.) In a well-designed configuration, it can be ensured that only scattered light from the fluid 22 will be collected by this fiber 72. The presence of mist 68 will cause a stronger $I_3$ signal, as compared to a gas with no condensates present. For this case, also, the transmitted light $I_2$ can be measured for normalization purposes, and the ratio $I_3/I_2$ can be used as the monitored quantity. Alternatively, and although not shown in FIG. 27, it should be understood that if the end of fiber 66 is not angled and, therefore, light from the end face reflection is allowed to reach the surface, this signal can be used as the normalization signal for $I_3$.

Method 1.4: Measurement of Differential Absorption.

Figure 28:
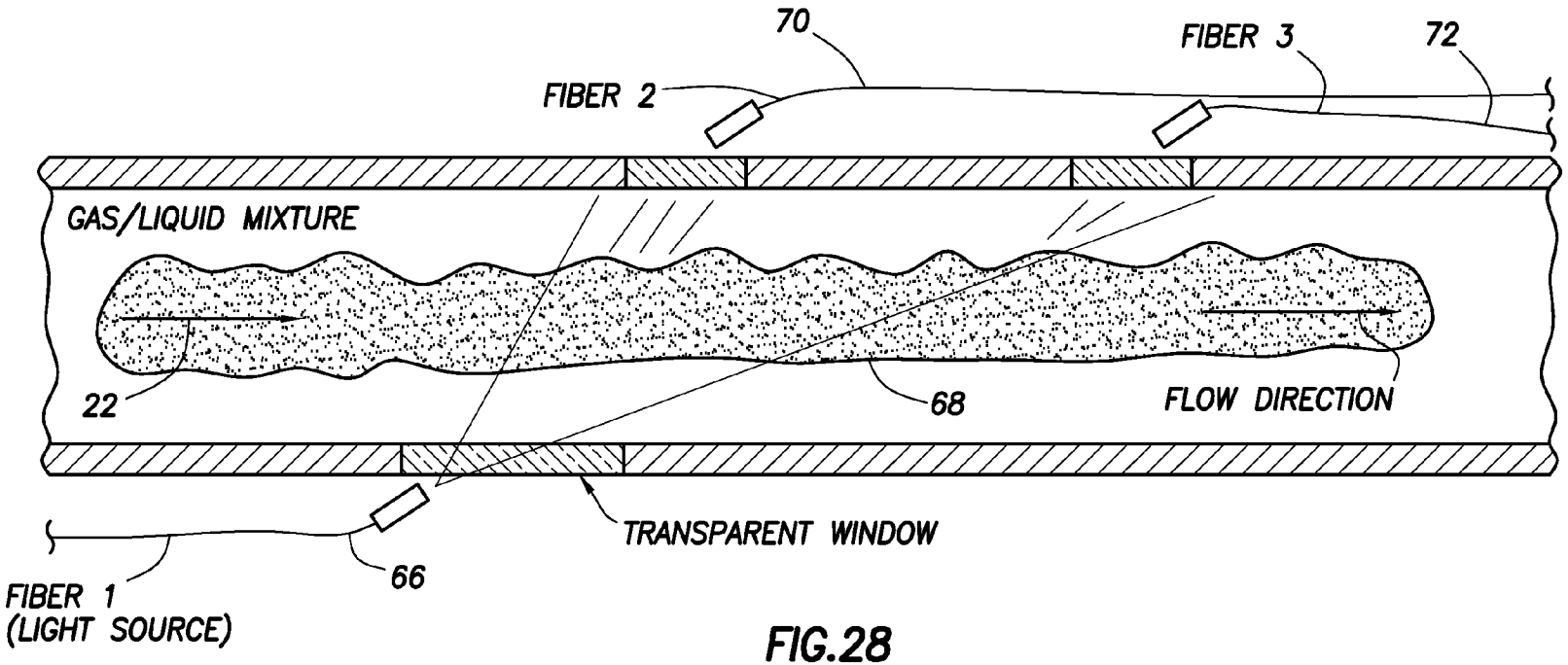
FIG. 28 is a representative cross-sectional view of another optical condensate sensor.

This method is representatively illustrated in FIG. 28. It is similar to Method 1.1 except that two distinct fibers 70, 72 are used to detect the transmitted light. Those fibers 70, 72 are positioned relative to the launch fiber 66 in such a way that the path lengths of the transmitted light are different for the two receive fibers 70, 72. This means that the interaction with the mist 68 occurs a longer total length for one of the paths compared to the other. The comparison of $I_3$ and $I_2$ will therefore be strongly dependent on the attenuation due to presence of the mist 68. In particular, the ratio $I_3/I_2$ is a number that will not be affected by variations of power of the source, or percentage of coupled power, or any loss element that is common to all three fibers in the cable.

Common Elements

It should be clear that a practical implementation of the concepts just described will require surface electronics, downhole cables, and many pieces of hardware to create a sensor 24 suitable for downhole deployment. In particular, it is contemplated that transparent windows and lenses (including the possible use of graded optics lenses) will be useful to optimize the light delivery and collection for the approaches shown in FIG. 27.

Extrinsic Detection Based on Modified Reflection or Transmission Due to the Presence of a Liquid It is well known that at the transition between two optical media of index of refraction $n_1$ and $n_2$, respectively, there occurs both reflection and refraction. For incidence perpendicular to the interface, the ratio of reflected power to the incident power is given by:

$$R = \left(\frac{n_1 - n_2}{n_1 + n_2}\right)^2$$

R is the reflectance. This type of reflection is called Fresnel reflection. On the other hand, refraction concerns the transmitted beam and consists of a change of the angle of propagation relative to the normal of the interface. If $O_1$ is the incident angle and $O_2$ the angle of the refracted beam, the relation between the two (called Snell's Law) is as follows:

$$n_1 \sin(\theta_1) = n_2 \sin(\theta_2)$$

Those two fundamental aspects of optical physics can serve as mechanisms for the optical detection of condensates in a gas production system. This is because the condensed liquid will have a different index of refraction compared to the gas mixture. The index of refraction of the liquid phase will typically be in the range $1.3<n_2<1.5$, whereas the index of refraction of the gas mixture will typically be $n_2<1.1$. The index of refraction of the core of a typical doped-silica optical fiber is $n_1=1.48$, and therefore both reflection and refraction will be modified by the presence of the condensed liquid.

Method 2.1: Frustrated Fresnel Reflection

Figure 29:
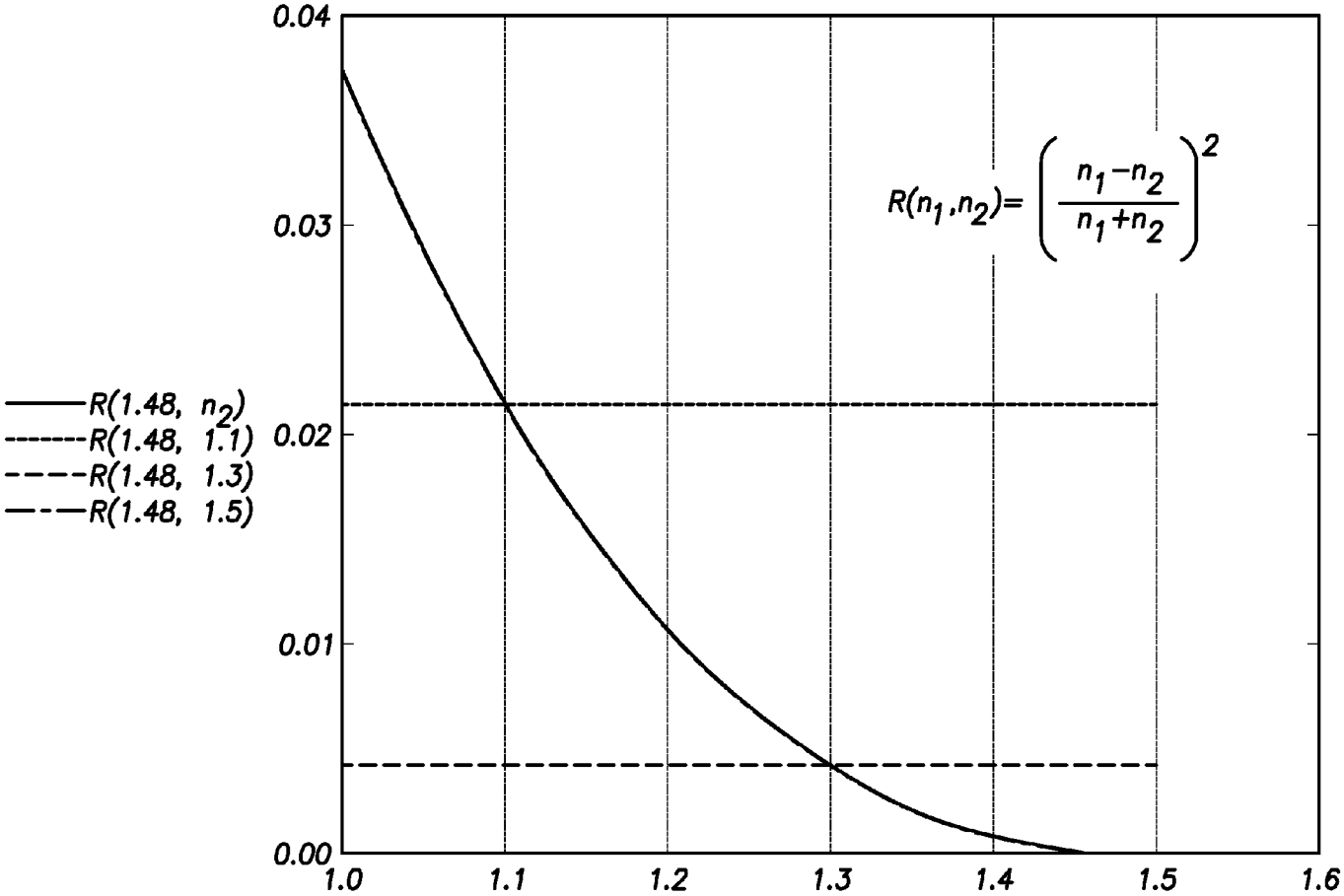
FIG. 29 is a representative graph of reflectivity vs. refractive index for an example of the optical condensate sensor.

Assuming the values of the indices of refraction just mentioned, we can easily calculate what the reflection would be at the cleaved end of an optical fiber (index $n_1$) in direct contact with a medium (index $n_2$). The results are depicted in FIG. 29. It can be seen that, if in the presence of gas mixture only, the reflectance R will be stronger than 2%, whereas if a liquid is present, the reflectance will be less than 0.5%.

Since the core area of an optical fiber is quite small, and therefore can be easily affected by a contaminant, it may be desirable to expand the beam of light that comes out of the fiber 66. This can be accomplished with various optical elements, including graded-index lenses.

Method 2.2: Modified Transmission due to Refraction Effects

Figure 30:
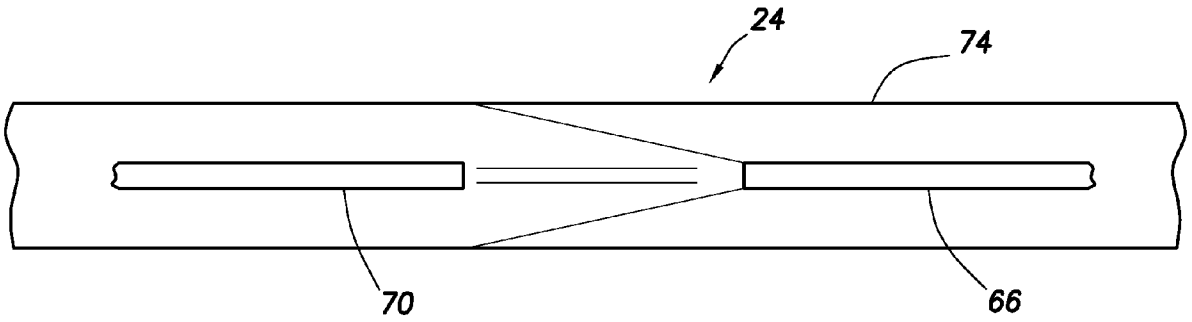
FIGS. 30 & 31 are representative cross-sectional views of another example of the optical sensor.
Figure 31:
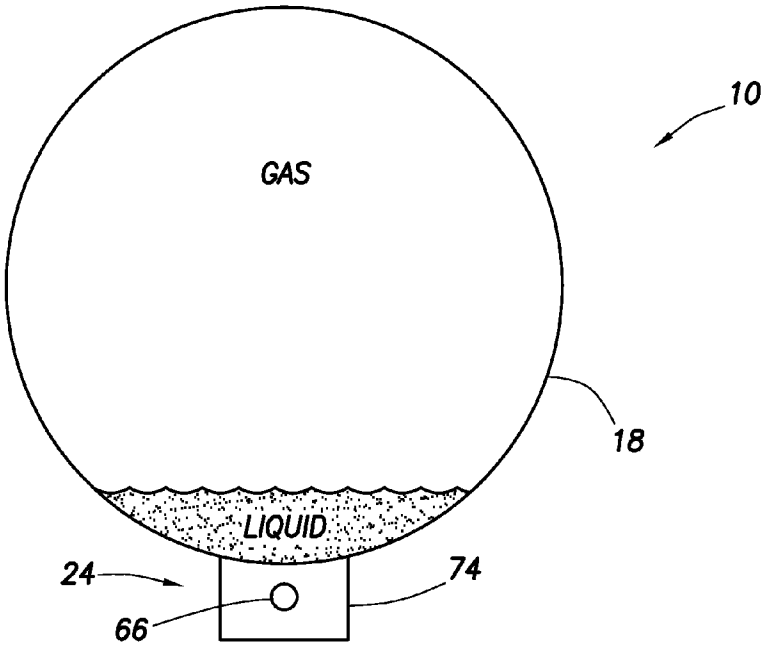

This method is representatively illustrated in FIGS. 30 & 31, in which the optical fibers 66, 70 are positioned in a cavity 74 at a lower end of the production conduit 18, so that any liquid in the fluid 22 will accumulate in the cavity. At the end of the optical fiber 66, the light beam diverges. The angle of divergence is dependent on the numerical aperture (NA) of the optical fiber 66, the distance between the two optical fiber ends, and the index of refraction of the surrounding medium. The coupling coefficient $\eta$ for this mechanism is given by:

$$\eta = 1 - \frac{xNA}{4an_0}$$

x is the fiber end separation. NA is the numerical aperture, a is the fiber core radius and n is the index of refraction. Expressed in dB, the loss L is:

$$L = -10\log\left(1 - \frac{xNA}{4an_0}\right)$$

Figure 32:
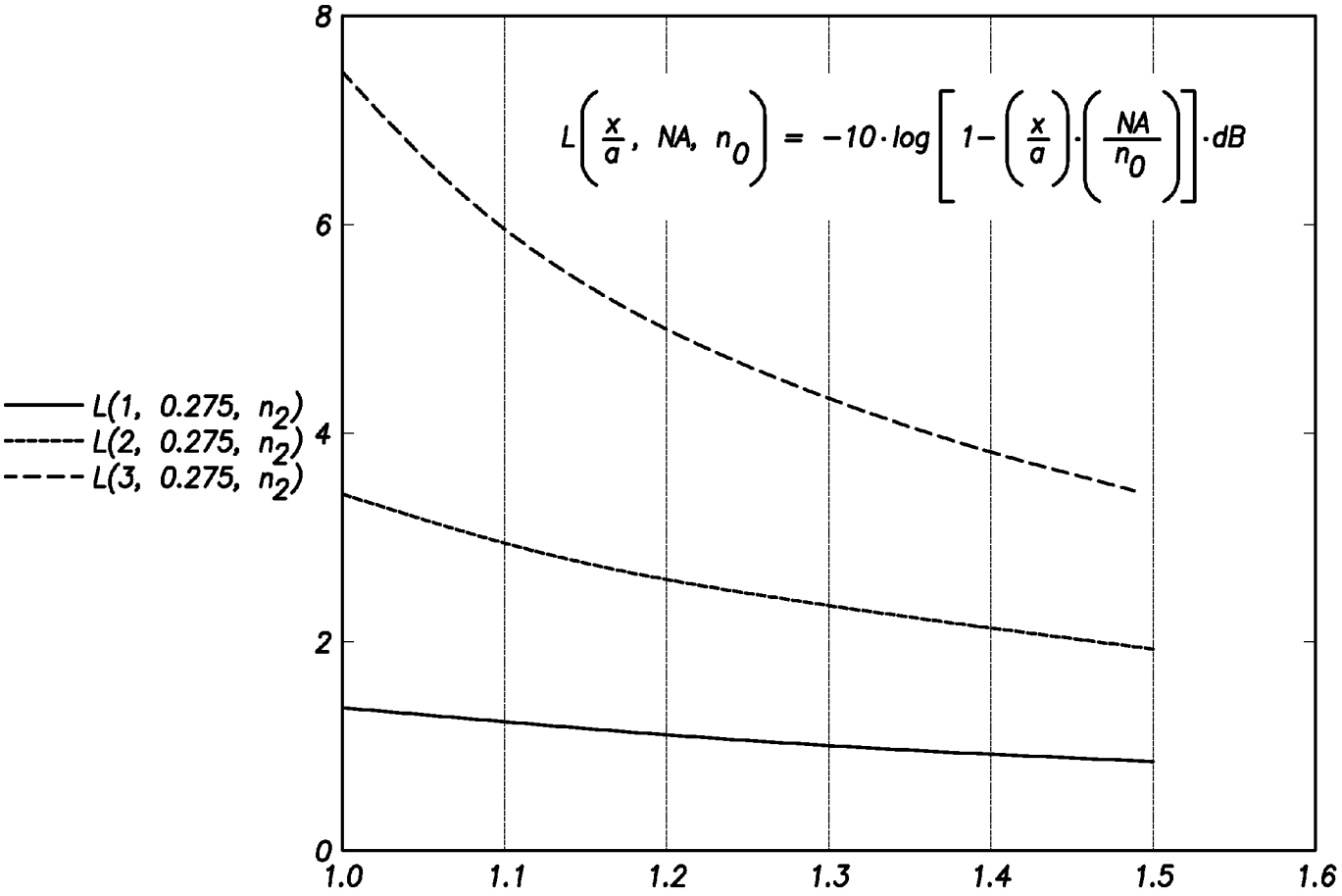
FIG. 32 is a representative graph of optical loss vs. refractive index for the FIGS. 30 & 31 example.

FIG. 32 depicts some numerical results. It can be seen from these results that for stronger distinction between gas ($n_2<1.1$) and liquid ($1.3<n_2<1.5$), larger separation is preferable, which also results in overall larger loss. This will limit the total number of zones 14*a-c* that can be interrogated if the sensors 24 are cascaded. The formula above is for fibers 66, 70 cleaved perpendicular to the fiber axis. Discrimination can be enhanced using angle-cleaved fiber ends at the expense of requiring specific lateral offsets between the fibers and care of the azimuthal orientations of the two fiber end faces. In this case too, it may be desirable to expand the beam to enhance the signal quality using graded-index lenses or other optics.

Intrinsic Detection Based on Evanescent Wave Absorption and Attenuated Total Internal Reflection An optical fiber is a waveguide. The propagation of light takes place in the core of the optical fiber because the index of refraction of the core ($n_{core}$) is higher than that of the cladding ($n_{cladding}$) and this results in total internal reflection. The electric field of the propagating light, however, still penetrates in the cladding with a decaying exponential amplitude of the form $e^{-\alpha r^2/2}$ where the attenuation coefficient $\alpha$ is given by:

$$\alpha = \left(\frac{2\pi n_{core}}{\lambda a}\right)\sqrt{2\frac{n_{core} - n_{cladding}}{n_{care}}}$$

Since the field is non-zero in the cladding, the intensity of the propagating light is affected by the presence of absorbing material in the cladding. An evanescent field sensor 24 relies on this fact by essentially letting the evanescent field penetrate a fluid 22 that surrounds the waveguide in order to obtain information about the fluid. In addition to absorption effect (the principle of the evanescent field sensor 24), there is also the fact that the closer the index of refraction of the "cladding" is to that of the core, the harder it is for light to be preserved in the core.

That is, when the index of refraction of the cladding becomes equal to or higher than that of the core, leakage of light out of the core takes place. This fact is the basis for the Attenuated Total Internal Reflection sensing method. Both these mechanisms can be used for the detection of condensates and are listed as Method 3.1 and Method 3.2 below.

Method 3.1: Detection Based on Evanescent Waves

The light source can be at a wavelength $\lambda_1$ that is favorably absorbed by the liquid phases compared to the gas phase in the fluid 22. This can be the case if $\lambda_1$ is selected such that it corresponds to a near-IR absorption peak due to C—H bonds. All hydrocarbons have C—H bonds, but the number of such bonds also clearly depends on the density. Since the condensed liquid will have higher density than the gas mixture, this technique can be made sensitive to the presence or absence of liquid in proximity to the fiber.

Figure 33:
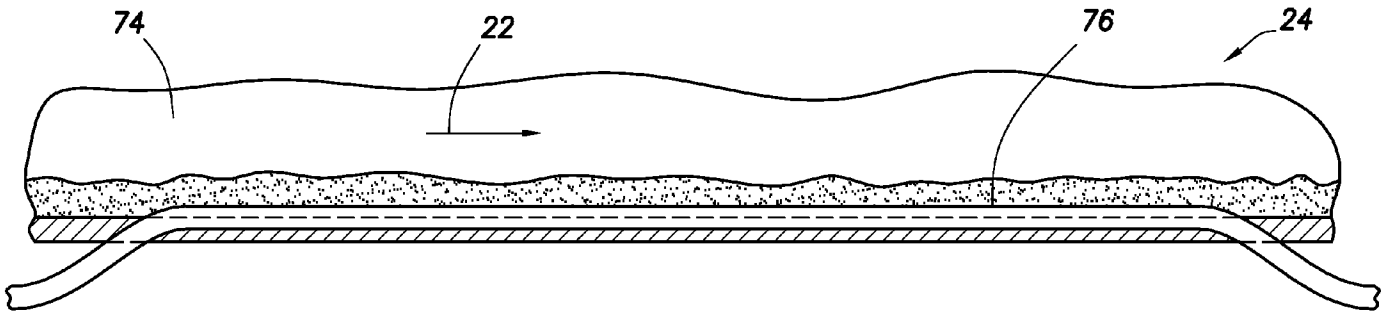
FIGS. 33-37 are representative views of further examples of the optical sensor.
Figure 34:
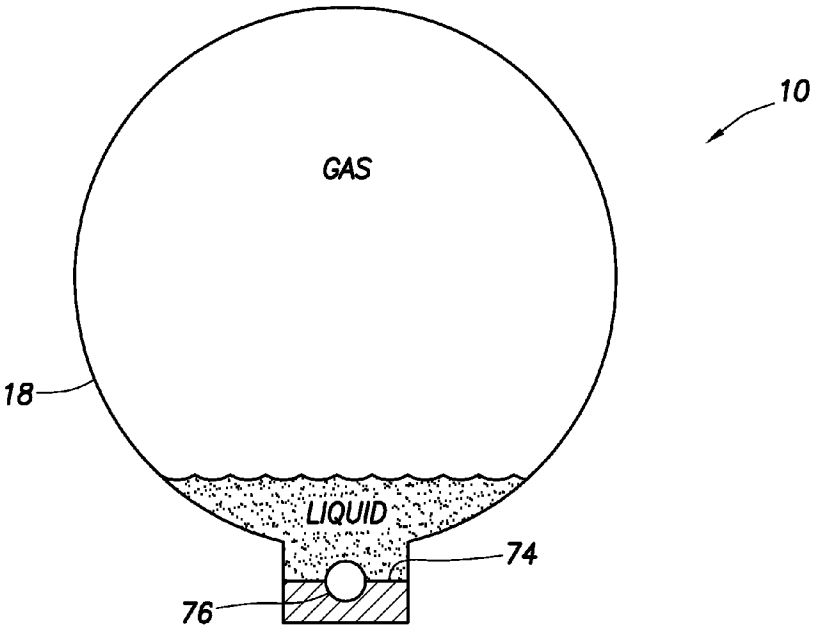

FIGS. 33-36 depict two approaches to achieve this. FIGS. 33 & 34 depict a longitudinally-disposed fiber 76. At least part of the surrounding of the fiber 76 has no coating so that contact between the fiber 76 cladding and the fluid 22 is possible. This technique has the fiber 76 placed in the cavity 74 where liquid will accumulate, such as on the low (bottom) side of a horizontally-deployed tool. Note that the fiber 76 could be made of sapphire instead of silica, in order to be more resistant to abrasion and moisture.

Figure 35:
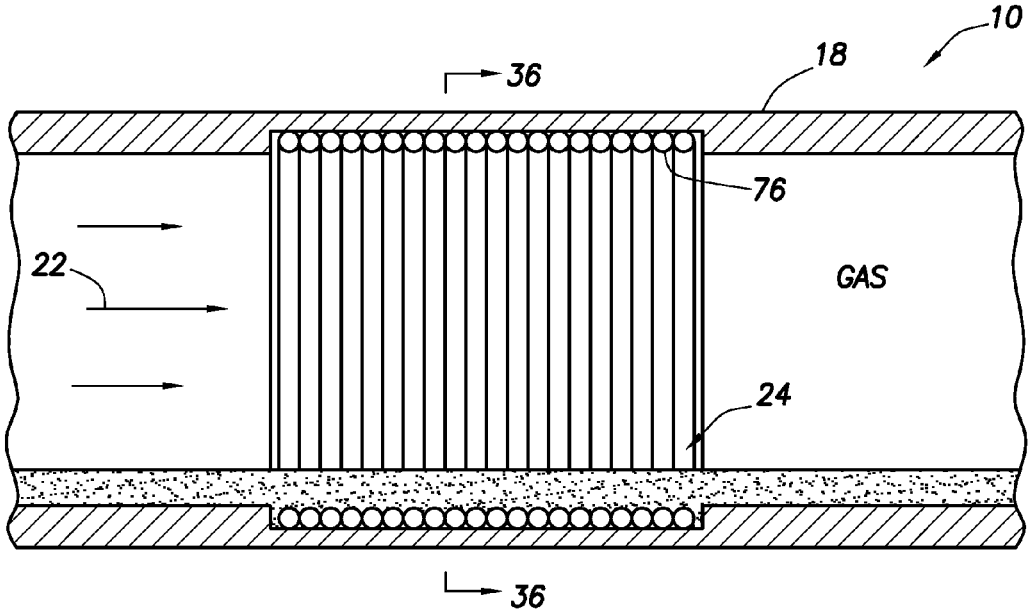
Figure 36:
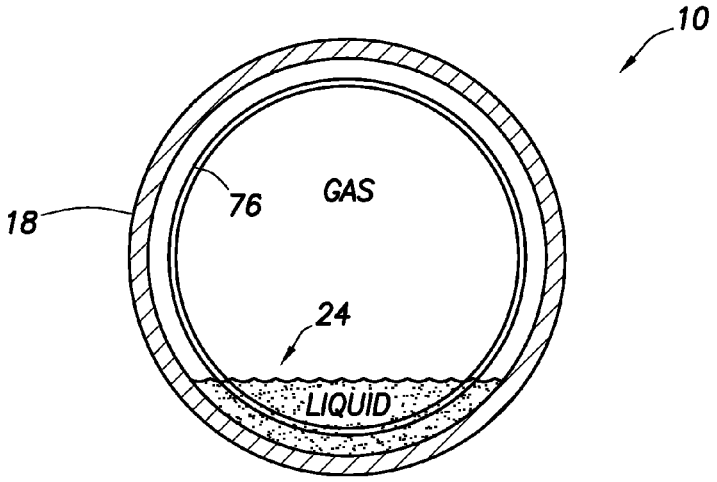

In FIGS. 35 & 36, the fiber 76 is disposed as a coil encircling flow of the fluid 22. With this configuration deployed in a horizontal section, there is always a portion of the fiber 76 that is on the low side where contact with a liquid can occur if such liquid is present.

Since several absorption peaks exist for the various hydrocarbon molecules of interest, it may also be beneficial to combine several laser sources, use a tunable laser, or alternately to use a broadband source and a spectroscopic detector. In other words, spectra of transmission can be obtained and processed at the surface to distinguish between the presence or not of liquid in the environment of the evanescent wave sensor 24.

Method 3.2 Attenuated Total Internal Reflection

Since propagation takes place when $n_{core}>n_{cladding}$, a waveguide can be made of a circular glass core surrounded directly by the fluid 22 (gas mixture or liquid). Propagation will take place as long as the core index remains larger than that of the cladding. This arrangement is depicted in FIG. 37.

The total number of modes that can propagate depends on the quantity $\Delta=(n_{core}-n_{cladding}/n_{core}$. The higher the value of $\Delta$, the higher the number of modes that can be transmitted without loss due to out-coupling. This is because the higher order modes are associated with incidence that is less grazing and therefore more susceptible to couple out of the fiber 76.

Figure 37:
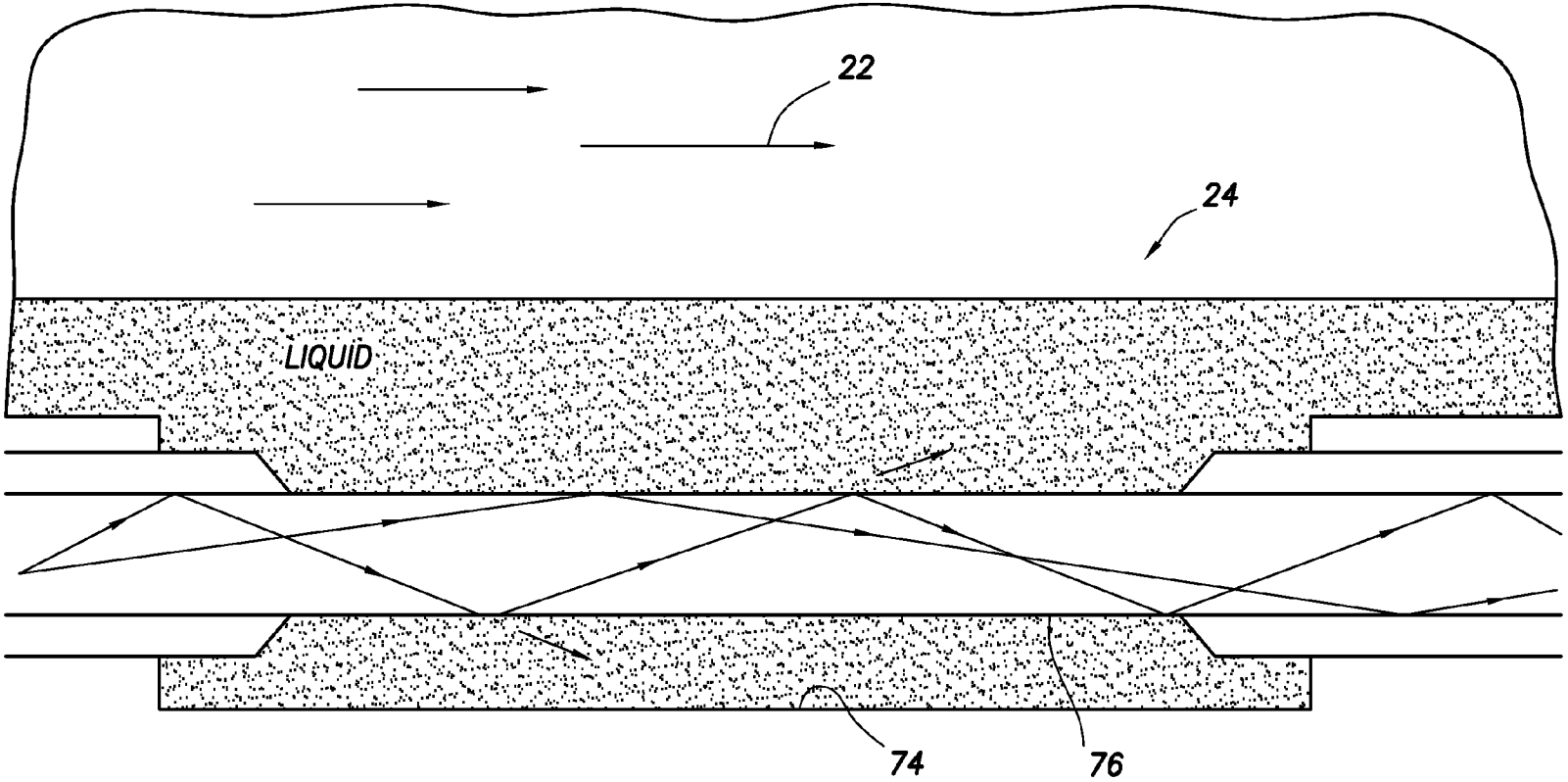

Therefore, for a clad-less fiber 76 where the surrounding fluid 22 acts as the cladding, as depicted in FIG. 37, the presence of a liquid results in a high value of $n_{cladding}$ and therefore a small $\Delta$. This implies that a liquid medium will yield a lower transmission (higher attenuation) compared to a gas-only fluid 22, and this is a principle by which the presence of condensates can be detected remotely.

The same general concept applies for a rectangular geometry, which is the more common attenuated total internal reflection method used in infrared spectroscopy.

Consideration of Light Sources and Detectors for Point Measurements

Figure 38:
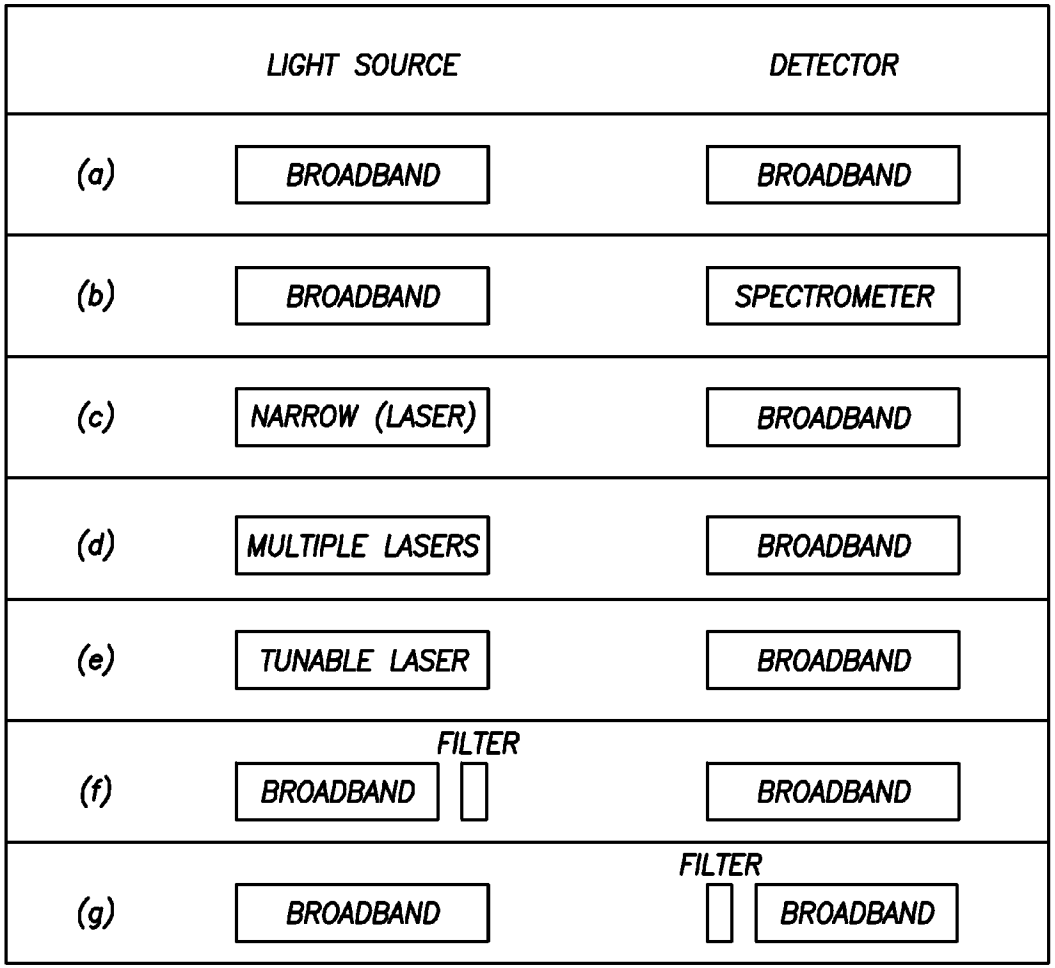
FIG. 38 is a table listing various combinations of light sources and detectors which may be used with the optical sensor.

For each of the methods discussed so far, there are a number of options for light sources and detectors. The principal configurations are listed in FIG. 38. The choice depends on whether the detection technique can take advantage of the spectral characteristics of the measurement. Evanescent wave absorption is clearly a technique that will favor specific wavelengths. Obtaining full spectrum information can be useful and this is accomplished using a tunable laser and a broadband detector, or a broadband source and a spectroscopic receiver (e.g., a spectrometer available from Ocean Optics Inc.).

Alternatively, using a filter adapted to let pass the wavelengths of interest can be a low-cost approach to increase the signal-to-noise ratio. Scattering tends to be stronger at the shorter wavelengths, whereas the absorption peaks are in the near-infrared range. For longer fiber 76 lengths (e.g., longer than 2.0 km), the use of wavelengths greater than 1100 nm are preferred, given the high attenuation below that wavelength in silica-based fibers.

Optical Time Domain Reflectometry Implementations of the Condensate Detection Techniques In Optical Time-Domain Reflectometry, a short pulse of light is sent into an optical fiber. A fast and sensitive detector is used to monitor the backscattered signal as a function of time. Scattering takes place at each location along the fiber and this scattered signal must travel through the fiber length from its location to the detector (located at the same end as the light source). This means that the arrival time t of the signal is related to position along the fiber via $z=vt/2$, where v is the speed of light in the optical fiber and the division by 2 comes from the fact that the detected pulse travels the fiber in both directions to and from position z. The amplitude of the signal at time t depends on the scattering coefficient at position z(t) and the total attenuation of the travel of the pulse in both directions to and from that position. Many commercial instruments exist to obtain OTDR measurements in optical fibers and can work for distances of 40 km and beyond. These instruments measure total loss as a function of distance based on the assumption of uniform scattering coefficient along the fiber. Spatial resolutions of 1 m or better are common.

The OTDR technique can be combined with the detection approaches discussed above that rely on an attenuation measurement. Methods 1.1, 3.1 and 3.2 are particularly well suited for this. It should be noted that the laser source used in the OTDR technique can be selected at a particular wavelength where the loss is optimized for the application.

Figure 39:
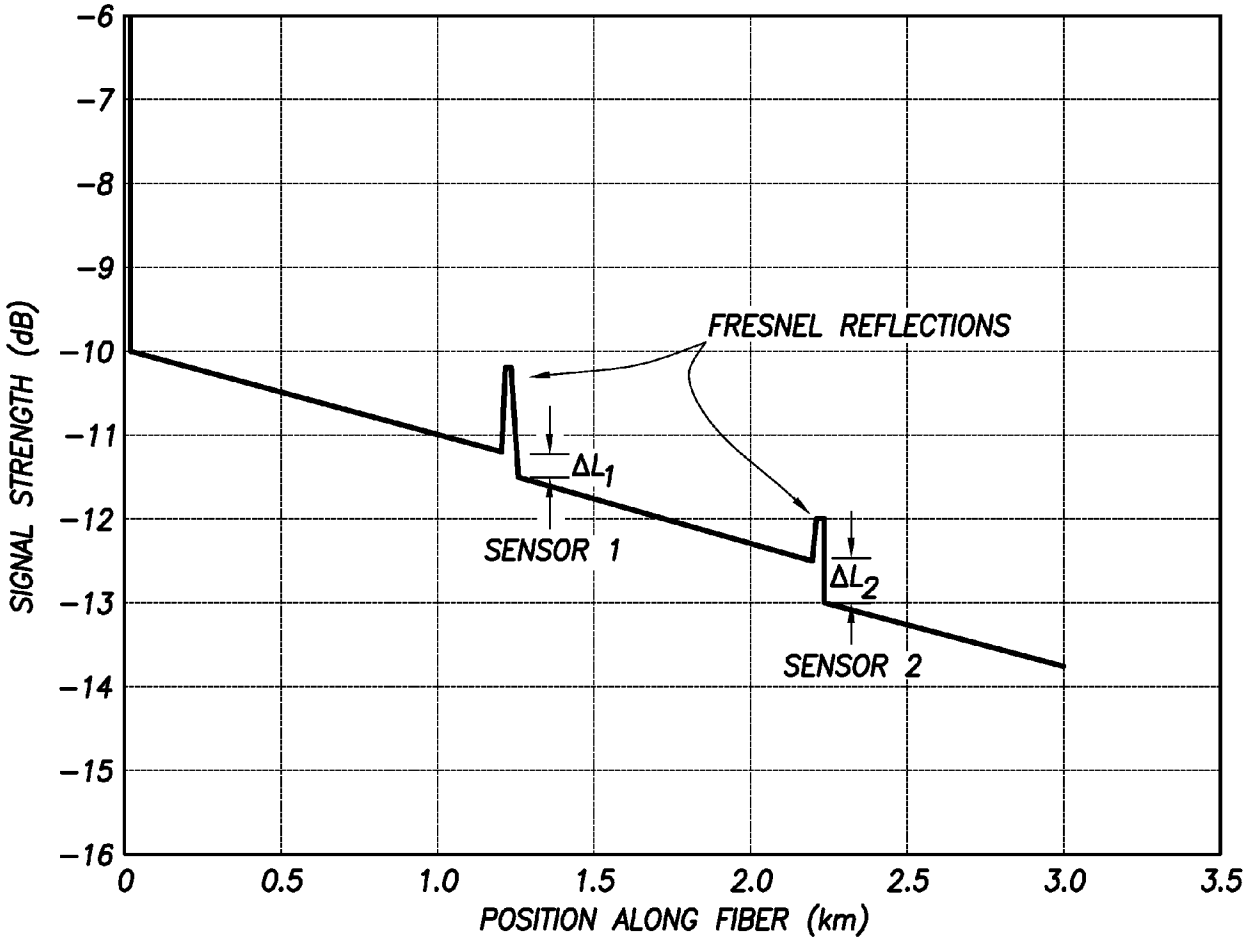
FIG. 39 is a graph of signal strength vs. position along an optical fiber.

FIG. 39 illustrates the type of output that the OTDR equipment could produce. Losses $\Delta L_1$ and $\Delta L_2$ are directly related to the presence or not of condensates based on one of the techniques described above. The Fresnel reflection peaks can also be used for the sensing principle.

The dynamic range of the OTDR is one of its principal parameters. Measurement sensitivity, number of sensors 24, and total range all compete for this dynamic range and it becomes an optimization problem to determine how to best allocate this dynamic range. For example, greater discrimination and sensitivity will be obtained if the "true" or "false" signal for presence or not of a liquid corresponds to a large loss difference. However, such large loss, added for each sensor 24, can quickly add to the total dynamic range available. Likewise, long fiber lengths will mean a larger proportion of the total loss due to the optical fiber attenuation itself, which decreases the dynamic range available for measurements.

Fresnel reflection (Method 2.1) can also be observed by OTDR and results in a peak in the returned signal. The height of this peak is directly related to the Fresnel reflection. This measurement may be difficult because the reflected energy is "spread" in time in an unpredictable way that makes it difficult to correlate to a specific value of reflection. However, with proper design of the signal processing it is conceived that this limitation can be overcome.

The techniques described here specifically target the detection of condensate formation in a subterranean area. Other techniques had not targeted this application and were more for the determination of composition and the determination of various thermodynamic properties.

Using fiber optic techniques means no downhole electronics, sensors and cables are insensitive to electromagnetic radiation, can be used in high temperature environments, and when combined with OTDR, can be deployed in multi-zones 14*a-c* with minimum cabling.

Low total system cost due to multiplexing ability is possible. Many of the approaches listed here are low-complexity approaches that should be producible at low to moderate cost.

The above disclosure provides to the art a method 30 of flowing fluid 22 from a formation 26. The method 30 can include sensing presence of a reservoir impairing substance in the fluid 22 flowed from the formation 26, and automatically controlling operation of at least one flow control device 20 in response to the sensing of the presence of the substance.

The fluid 22 may comprise a hydrocarbon gas (including mixtures of various types of hydrocarbon gases).

Multiple flow control devices 20 can regulate flow of the fluid 22 from multiple respective zones 14*a-c* of the formation 26. Each of the flow control devices 20 can be independently operable in response to the sensing of the presence of the substance.

The sensing of the presence of the substance may be performed by multiple sensors 24. Each of the multiple flow control devices 20 can be operable in response to the sensing of the presence of the substance by a corresponding one of the sensors 24.

The sensing of the presence of the substance may be performed by at least one sensor 24 which detects formation of at least one of mist, fog and dew in the fluid 22.

The sensing of the presence of the substance may be performed by at least one sensor 24 which detects an increase in density of the fluid 22.

A first densitometer 24*a* may be positioned upstream of a flow restriction (e.g., orifice 34), and a second densitometer 24*b* may be positioned downstream of the flow restriction, and the sensing of the presence of the substance can be indicated by a change in density of the fluid 22 as it flows through the flow restriction.

The sensing of the presence of the substance may be performed by a sensor 24 which detects reflection of light off of at least one of mist 68 or fog or dew formed in a flow restriction (e.g., in the flow control device 20).

The sensing of the presence of the substance may be performed by a sensor 24 which locally reduces pressure of the fluid 22 at the sensor 24.

The sensing of the presence of the substance may be performed by a sensor 24 which locally reduces temperature of the fluid 22 at the sensor 24.

The presence of the substance can be sensed by detecting reduced resistance between electrodes 42 in the presence of the substance.

The sensing of the presence of the substance may be performed by a sensor 24 which simulates conditions in the formation 26.

The sensing of the presence of the substance may be performed by a sensor 24 which detects acoustic noise indicative of the presence of the substance. The acoustic noise can be detected by sensing dynamic strain along an optical waveguide 48. The dynamic strain can generate a proportional optical path length change in the optical waveguide 48.

The sensing of the presence of the substance may be performed by an optical sensor 24 which senses a change in index of refraction.

The sensing of the presence of the substance may be performed by an optical sensor 24 which senses light scattered by the substance.

The sensing of the presence of the substance may be performed by an optical sensor 24 which senses differential absorption of light by the substance.

The sensing of the presence of the substance may be performed by an optical sensor 24 which senses a change in reflection of light due to the presence of the substance.

The sensing of the presence of the substance may be performed by an optical sensor 24 which senses a change in transmission of light due to the presence of the substance.

The sensing of the presence of the substance may be performed by an optical sensor 24 which detects Fresnel reflection as an indicator of the presence of the substance.

The sensing of the presence of the substance may be performed by an optical sensor 24 which detects evanescent wave absorption as an indicator of the presence of the substance.

The sensing of the presence of the substance may be performed by an optical sensor 24 which detects attenuated total internal reflection as an indicator of the presence of the substance.

The substance may comprise a condensate, a precipitate, or a sublimate.

Also described above is a well system 10 which may include at least one sensor 24 which senses whether a reservoir impairing substance is present, and at least one flow control device 20 which regulates flow of a fluid 22 from a formation 26 in response to indications provided by the sensor 24.

Although in the above described examples the fluid 22 is produced from the formation 26, the fluid could be flowed from the formation in other circumstances. For example, the fluid 22 could be flowed from the formation 26 during a formation test, such as, during a drawdown test.

Although the sensor 24 examples are described above as being used for sensing the presence of condensate, it will be appreciated that, with appropriate modification, calibration, etc., some or all of the sensors could be useful for sensing the presence of precipitates or sublimates.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. A "fluid" can be a liquid, a gas, or a mixture or other combination of fluids.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of producing fluid from a formation, the method comprising:

detecting impending condensing conditions for a reservoir impairing substance which is present in the fluid, wherein a first densitometer is positioned upstream of a flow restriction, and a second densitometer is positioned downstream of the flow restriction, whereby the impending condensing conditions are indicated by a change in density of the fluid as the fluid flows through the flow restriction; and automatically adjusting a flow control device in response to the detecting, thereby preventing the reservoir impairing substance from condensing in flow passages within the formation and in a wellbore intersecting the formation during production of the fluid.

2. The method of claim 1, wherein the fluid comprises a hydrocarbon gas.

3. The method of claim 1, wherein multiple flow control devices regulate flow of the fluid from multiple respective zones of the formation, and wherein each of the flow control devices independently operates in response to the detecting.

4. The method of claim 3, wherein the detecting is performed at each of the multiple zones, and wherein each of the multiple flow control devices operates in response to the detecting at a corresponding one of the multiple zones.

5. The method of claim 1, wherein the impending condensing conditions are indicated by an increase in density of the fluid.

6. A method of flowing fluid from a formation, the method comprising:

sensing presence of a reservoir impairing substance in the fluid flowed from the formation; and automatically controlling operation of at least one adjustable choke in response to the sensing of the presence of the substance, wherein a first densitometer is positioned upstream of a flow restriction, and a second densitometer is positioned downstream of the flow restriction, whereby the sensing of the presence of the substance is indicated by a change in density of the fluid as it flows through the flow restriction.

7. A well system, comprising:

at least one sensor which detects impending condensing conditions for a reservoir impairing substance which is present in a fluid being produced from a subterranean formation, wherein the at least one sensor comprises a first densitometer positioned upstream of a flow restriction, and a second densitometer positioned downstream of the flow restriction, whereby the impending condensing conditions are indicated by a change in density of the fluid as the fluid flows through the flow restriction; and at least one flow control device which automatically regulates flow of the fluid into a wellbore intersecting the formation in response to detection by the sensor of the impending condensing conditions, thereby preventing the reservoir impairing substance from condensing in flow passages within the formation and in the wellbore during production of the fluid.

8. The system of claim 7, wherein each of multiple flow control devices regulates the flow of the fluid from a respective one of multiple zones of the formation in response to the detection by a respective one of multiple sensors.

9. The system of claim 7, wherein the fluid comprises a hydrocarbon gas.

10. A well system, comprising:

at least one sensor which detects impending condensing conditions for a reservoir impairing substance which is present in a fluid being produced from a subterranean formation, wherein the sensor senses light scattered by the substance, wherein the at least one sensor comprises a first optical fiber which launches the light and a second optical fiber which receives the light, and wherein the second optical fiber is not on a same axis as the first optical fiber, and wherein the at least one sensor comprises a first densitometer positioned upstream of a flow restriction, and a second densitometer positioned downstream of the flow restriction, whereby the impending condensing conditions are indicated by a change in density of the fluid as the fluid flows through the flow restriction; and at least one flow control device which automatically regulates flow of the fluid into a wellbore intersecting the formation in response to detection by the sensor of the impending condensing conditions, thereby preventing the reservoir impairing substance from condensing in flow passages within the formation and in the wellbore during production of the fluid.

11. A method of producing fluid from a formation, the method comprising:

detecting impending precipitation conditions for a reservoir impairing substance in solution with the fluid, wherein a first densitometer is positioned upstream of a flow restriction, and a second densitometer is positioned downstream of the flow restriction, whereby the impending precipitation conditions are indicated by a change in density of the fluid as the fluid flows through the flow restriction; and automatically adjusting a flow control device in response to the detecting, thereby preventing the reservoir impairing substance from precipitating in flow passages within the formation and in a wellbore intersecting the formation during production of the fluid.

12. The method of claim 11, wherein the fluid comprises a hydrocarbon liquid.

13. The method of claim 11, wherein multiple flow control devices regulate flow of the fluid from multiple respective zones of the formation, and wherein each of the flow control devices independently operate in response to the detecting.

14. The method of claim 11, wherein the detecting is performed by multiple sensors, and wherein each of the multiple flow control devices operates in response to the detecting by a corresponding one of the sensors.

15. A well system, comprising:

at least one sensor which detects impending precipitation conditions for a reservoir impairing substance in solution with a fluid being produced from a subterranean formation, wherein the at least one sensor comprises a first densitometer positioned upstream of a flow restriction, and a second densitometer positioned downstream of the flow restriction, whereby the impending precipitation conditions are indicated by a change in density of the fluid as it flows through the flow restriction; and at least one flow control device which automatically regulates flow of the fluid into a wellbore intersecting the formation in response to detection by the sensor of the impending precipitation conditions, thereby preventing the reservoir impairing substance from precipitating in flow passages within the formation and in the wellbore during production of the fluid.

16. The system of claim 15, wherein the flow control device automatically regulates the flow of the fluid in response to the detection.

17. The system of claim 15, wherein each of multiple flow control devices regulates the flow of the fluid from a respective one of multiple zones of the formation in response to the detection by a respective one of multiple sensors.

18. The system of claim 15, wherein the fluid comprises a hydrocarbon liquid.

* * * * *